US005886954A

United States Patent [19]

Asami et al.

[11] Patent Number: 5,886,954

[45] Date of Patent: Mar. 23, 1999

[54] ELECTRONIC DEVICES WITH A SOLAR CELL

[75] Inventors: Yoshinori Asami, Fussa; Tomoo Kasuo, Hamura; Haruo Kajitani, Akiruno; Akio Kurosu, Ome; Haruo Ono, Akishima, all of Japan

[73] Assignee: Casio Computer Co., Ltd., Tokyo, Japan

[21] Appl. No.: 128,561

[22] Filed: Aug. 3, 1998

[30] Foreign Application Priority Data

| | | | |
|---|---|---|---|
| Aug. 20, 1997 | [JP] | Japan | 9-223841 |
| Aug. 20, 1997 | [JP] | Japan | 9-223842 |
| Aug. 21, 1997 | [JP] | Japan | 9-224513 |

[51] Int. Cl.[6] ..... G04B 19/30

[52] U.S. Cl. ..... 368/67; 360/227

[58] Field of Search ..... 368/67, 68, 203–205, 368/227, 276

[56] References Cited

U.S. PATENT DOCUMENTS

| | | | |
|---|---|---|---|
| 3,963,885 | 6/1976 | Brien | 200/52 R |
| 4,003,197 | 1/1977 | Harer | 348/67 |
| 5,612,931 | 3/1997 | Sato et al. | 368/67 |

*Primary Examiner*—Vit Miska

*Attorney, Agent, or Firm*—Frishauf, Holtz, Goodman, Langer & Chick

[57] ABSTRACT

An electronic device comprising a solar cell, a secondary battery charged by an output from the solar cell, an illumination detector for detecting the brightness of the environment of the solar cell based on the output from the solar cell, a display unit, an electroluminescence (EL) element for illumining the display unit, an attitude detector for detecting an attitude of the electronic device, a driver for driving the EL element on the basis of the attitude of the electronic device detected by the attitude detector and the result of the detection by the illumination detector. Only when the illumination detector detects that the environment of the solar cell is dark, and the attitude detector detects that the electronic device takes a specified attitude, the EL element is turned on. Otherwise, the illuminator is not turned on. Thus, wasteful power consumption is suppressed to prolong the solar cell's service life.

14 Claims, 16 Drawing Sheets

| | | |
|---|---|---|
| LEVEL "1" | | NORMAL OPERATION |
| LEVEL "2" | | NORMAL OPERATION |
| LEVEL "3" | | SOUNDING, EL TURNING ON ARE IMPOSSIBLE |
| LEVEL "4" | | SOUNDING, EL TURNING ON, AND LCD TURNING ON ARE IMPOSSIBLE (TURNABLE ON FOR ONE MINUTE WITH SWITCH) |
| LEVEL "5" | ALL TIME RECORDING (OSCILLATION) AND INFORMATION DISPLAYING OPERATIONS ARE STOPPED, BUT RESTORABLE BY CHARGING. | |

ELECTRONIC DEVICES WITH A SOLAR CELL

BACKGROUND OF THE INVENTION

The present invention relates to electronic devices with a solar cell.

There are electronic wristwatches which each include an EL (electroluminescence) element which enables the time appearing in a time display unit to be visually recognized at night and a slant switch which is turned on when the wristwatch is slanted in a specified direction so that the EL element is turned on to illumine the time display unit.

With such arrangement, only by slanting the wristwatch in a specified direction without operating the switch, the EL element is turned on. Although no illumination is required, the EL element is automatically turned on only by slanting slightly an arm on which the wristwatch is worn to thereby increase wasteful power consumption.

In order to avoid such problem, U.S. Pat. No. 5,612,931 discloses that the user operates a switch to select one of an EL element on mode in which when a slant switch is turned on, the EL element is turned on, and an EL off mode in which even when the slant switch is turned on, the EL element is not turned on.

However, in such arrangement, the switching operation is troublesome. The user can often forget the switching operation, and the EL element can remain turned on even when no illumination is required, and wasteful power would be consumed.

Electronic devices are manufactured and marketed which each include a solar cell whose output voltage charges a capacitor or a secondary battery whose voltage drives that solar cell.

When such electronic device is of a small type and can only include a capacitor and/or a secondary battery, and if the EL element is tried to be driven by the voltage of the capacitor or secondary battery, the capacity or battery would soon become dead because the charging capacity of the capacitor or secondary battery is small. Thus, it is required to minimize wasteful power consumption.

SUMMARY OF THE INVENTION

It is an object of the present invention to provide an electronic device with a solar cell in which illumining means is turned on only when required and the illumining means is otherwise not turned on.

In order to achieve the above object, according to the present invention, there is provided an electronic device comprising:

- a solar cell;
- an electric storage means charged by an output from the solar cell;
- illumination detecting means for detecting the brightness of the environment of the solar cell based on the output from the solar cell;
- displaying means;
- illumining means for illumining the displaying means;
- attitude detecting means for detecting an attitude of the electronic device;
- driving means for driving the illumining means on the basis of the attitude of the electronic device detected by the attitude detecting means and the result of the detection by the illumination detecting means.

According to this arrangement, the illumining means is turned on only when the environment of the solar cell is dark and needs illumination and the device takes a specified attitude. The illumining means is otherwise not turned on, so that no wasteful power consumption is avoided.

DETAILED DESCRIPTION OF THE PREFERRED EMBODIMENTS

[First Embodiment]

Figure 1:
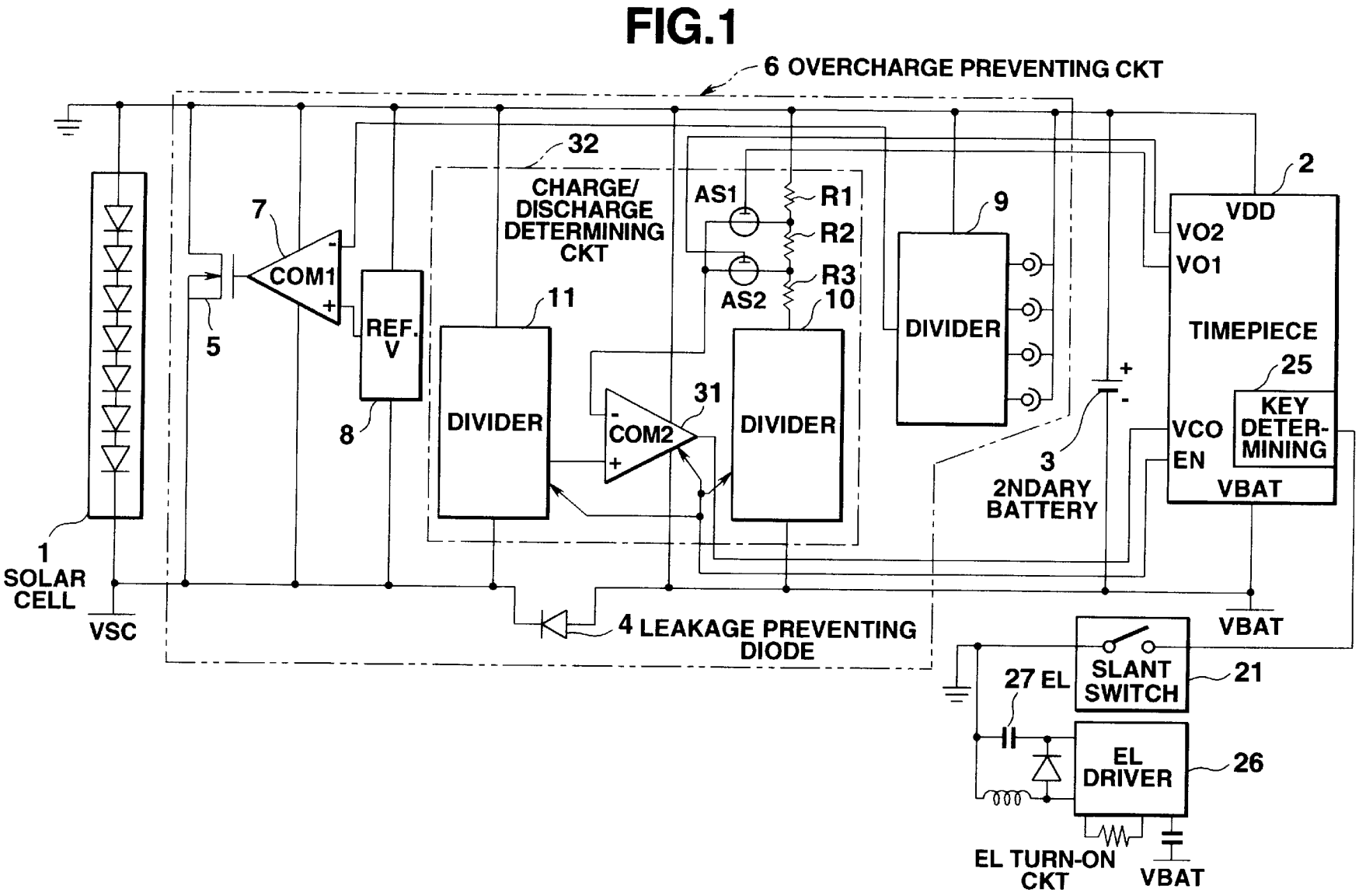
FIG. 1 is a block diagram of an electronic circuit of an electronic wristwatch with a solar cell as a first embodiment of the present invention.

A first embodiment of the present invention will be described next with reference to the accompanying drawings. FIG. 1 is a block diagram of an electronic wristwatch with a solar cell of the first embodiment.

Reference numeral 1 denotes a solar cell whose output voltage is fed to a timepiece 2 and also to a secondary battery 3. A leakage preventing diode 4 is provided between the secondary battery 3 and the solar cell 1.

An overcharge preventing circuit 6 and a charge/discharge determining circuit 32 which will be described in detail later are provided between the solar cell 1 and the timepiece 2.

Figure 2:
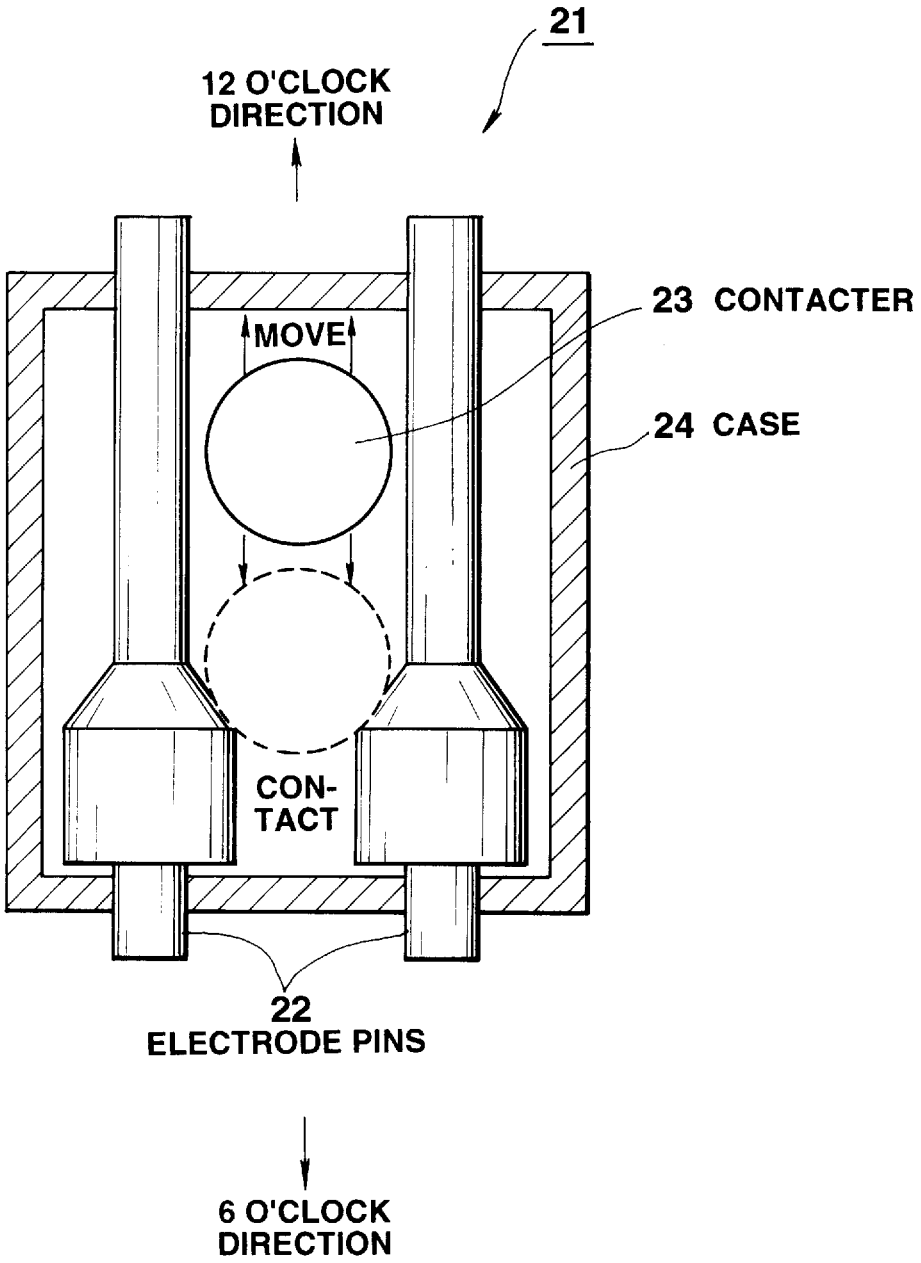
FIG. 2 shows the internal structure of a slant switch of FIG. 1.

Reference numeral 21 denotes a slant switch which, as shown in FIG. 2, is provided with a pair of electrode pins 22 each having a lower big end, and a ball-like metal or conductive contactor 23 enclosed in a case 24. When the slant switch 21 is slanted in a specified direction, the contactor comes into contact with the big ends of the pair of pins 22 to form a conductive path between the pair of electrode pins 22 and hence to turn on the switch 21.

When the wristwatch worn by a user is slanted to confirm the time so that the 6 o'clock of its face is directed vertically downward, the contactor 23 of the slant switch 21 comes into contact the two big ends of pair pins 22 or the switch is turned on.

The output from the slant switch 21 is delivered to a key determining circuit 25 of the timepiece 2. The timepiece 2 is connected via an EL driver 26 to an EL element 27. When the timepiece 2 outputs a drive signal from its ELD terminal to the EL driver 26, the EL driver 26 turns on the EL element 27 for a predetermined period of time and then turns off it automatically.

In the overcharge preventing circuit 6, a comparator (COM 1) 7 receives at its inverting input terminal an output voltage from a voltage divider 9 which divides an output voltage from the secondary battery 13, and also receives at its non-inverting input terminal a reference voltage from a reference voltage generator 8 which obtains the reference voltage by dividing the output voltage from the solar cell 1. When the division of the output voltage from the secondary battery 3 exceeds the reference voltage, the comparator 7 turns on a transistor 5 to shortcut the output from the solar cell 1.

A comparator (COM 2) 31 compares voltages at both ends of the leakage preventing diode 4. The comparator 31 receives at its inverting input terminal via analog switches AS1 and AS2 a voltage obtained by dividing by resistors R1, R2 and R3 an output voltage from a divider 10 which divides the output voltage VBT from the secondary battery 3, and also receives at its non-inverting input terminal an output voltage from a divider 11 which divides the output voltage VSC from the solar cell 1. The resistors R1, R2 and R3; analog switches AS1, AS2; and comparator 31 compose a charge/discharge determining circuit 32 which determines whether the secondary battery (Ni-Cd/Lithium battery) 13 is in a charged/discharged state.

The output from the comparator 31 is fed to a terminal VCO of the timepiece 2 whose CPU (not shown) determines the charged/discharged states of the secondary battery 3 based the states of the analog switches AS1 and AS2 and a change in the output voltage from the comparator 31.

For example, when the analog switches AS1 and AS2 are on and off, respectively, a voltage determined by a ratio of resistor value R1 to resistor value (R2+R3) is applied to the inverting input terminal of the comparator 31. At this time, when the following relationship holds between the output voltage VSC (precisely, a voltage obtained by dividing the VSC) from the solar cell 1 and the output voltage VBAT (voltage obtained by dividing the voltage VBAT from the secondary battery 3) from the secondary battery 3

$$|VSC|-|VBAT|<0.1\ V,$$

the output voltage from the comparator 31 becomes high (ground level) (this state is hereinafter referred to as a "classification 1"). Since the signals which turn on and off the analog switches AS1 and AS2, respectively, are fed from the output terminals VO1 and VO2 of the timepiece 2, the states of the analog switches AS1 and AS2 can be known from the output signals from the output terminals VO1 and VO2, respectively.

The absolute value of the voltage VCS of the solar cell 1 becomes smaller than the absolute value of the voltage VBAT of the secondary battery 3 plus 0.1 V when the absolute value of the output voltage from the solar cell 1 is small or the environment of the solar cell 1 is dark and the solar cell 1 cannot charge the secondary battery 3.

Thus, by checking the output from the comparator 31 when the analog switches AS1 and AS2 are in a specified state (in this case, AS1 and AS2 are on and off, respectively), it can be determined whether the secondary battery 3 is being charged by the solar cell 1 at present or otherwise discharging.

Next, when the analog switches AS1 and AS2 are on and off, respectively, and $$|VSC|-|VBAT|>0.1\ V, \quad \text{(i)}$$

the output from the comparator 31 becomes low (VSC level).

When the analog switches AS1 and AS2 are off and on, respectively, and $$|VSC|-|VBAT|<0.25\ V, \quad \text{(ii)}$$

the output from the comparator 31 becomes high (the states (i) and (ii) are hereinafter referred to as a "classification 2". In this case, the absolute value of the output voltage VSC from the solar cell 1 is larger than |VBAT|+0.1 V and smaller than |VBAT|+0.25 V or the output voltage from the solar cell 1 is not so high, so that the solar cell 1 cannot charge the secondary battery 3, but feeds a part of the required drive voltage.

Thus, by checking the output from the comparator 31 when the analog switches AS1 and AS2 are off and on, respectively, it can be determined whether the environment of the solar cell 1 is light and the solar cell 1 is charging the secondary battery 3 or whether the environment of the solar cell is dark and the solar cell 1 is feeding a part of the required drive voltage.

Next, when the analog switches AS1 and AS2 are off and on, respectively, and $$|VSC|-|VBAT|>0.25\ V,$$

the output from the comparator 31 becomes low (this state is hereinafter referred to as a "classification 3").

In this case, the absolute value of the voltage VSC of the solar cell 1 is larger than |VBAT|+0.25 V or the environment of the solar cell 1 is light and the output voltage from the solar cell 1 is high.

Thus, by checking the output from the comparator 31 when the analog switches AS1 and AS2 are off and on, respectively, it can be determined whether the solar cell 1 is charging the secondary battery 3 or not.

As described above, by turning on and off the analog switches AS1 and AS2, respectively, which changes the input voltage level to the comparator 31, and determining the output from the comparator 31, the states of the solar cell 1 can be classified into three states; that is, a state in which the absolute value of the output voltage from the solar cell 1 is small and the solar cell 1 cannot charge the secondary battery 3 (classification 1), a state in which the absolute value of the output from the solar cell 1 is not so large, but the solar cell 1 is feeding a part of the required drive voltage (classification 2), and a state where the absolute value of the output voltage from the solar cell 1 is large and the solar cell 1 is sufficiently charging the secondary battery 3 (classification 3).

For those three states, that the absolute value of the output voltage from the solar cell 1 is large implies that a quantity of light which the solar cell 1 receives is large or its environment is light; that the absolute value of the output voltage from the solar cell 1 is not so large implies that its environment is not so light, and that the absolute value of the output from the solar cell 1 is small implies that its environment is dark.

By determining the states of the analog switches AS1 and AS2 and the output from the comparator 31, it can be determined whether the external environment is (1) light, (2) dim or (3) dark. The result of this determination can be used for switching off and on the auto E1 mode. That is, when the environment of the solar cell is light and dark, respectively, the auto EL mode can be turned off and on, respectively.

When it is determined that the charge/discharge determining circuit 32 is charging the secondary battery 3 in the FIG. 1 circuit, the environment of the solar cell is light. Thus, the auto E1 mode is turned off whereas it is determined that the secondary battery 3 is discharging, the environment of the solar cell is dark. Thus, the auto EL mode is turned on.

Only by the determination of the charge/discharge determining circuit 32, the EL element 27 would be turned on when its environment is dark even if the EL element 27 is not required to be turned on. Thus, for example, the auto EL off mode is set unconditionally as setting "1" to avoid turning on the EL element 27; only when the conditions of the classification "1" are satisfied or only when the environment of the solar cell is dark, the auto EL on mode is set as setting "2" in which mode the EL element 27 is turned on or off depending on the state of the slant switch 21; and when the conditions of the classifications "1" and "2" are satisfied or when the environment is dark or dim, the auto EL on mode is set as setting "3" in which mode the EL element 27 is turned on or off depending on the state of the slant switch 21. By selecting one of the settings optionally, the user can determine to what degree of darkness the auto EL mode should be set and when the slant switch 21 is turned on, the EL element 27 should be turned on.

If the state of the solar cell corresponding to the classification "1", "2", or "3" is indicated on a liquid crystal display of the face of the timepiece, it can be known whether the solar cell 1 is charging the secondary battery, whether the solar cell does not charge the secondary battery 3, but is feeding a part of the drive voltage, or whether the solar cell cannot charge the secondary battery 3. Thus, the user can determine whether there is brightness enough to charge the solar cell.

While in the first embodiment the analog switches AS1 and AS2 switch the input voltage level to the comparator 31, the present invention is not limited to this particular case. For example, the voltage level may be switched with a transistor or an IC.

[Second Embodiment]

Figure 3:
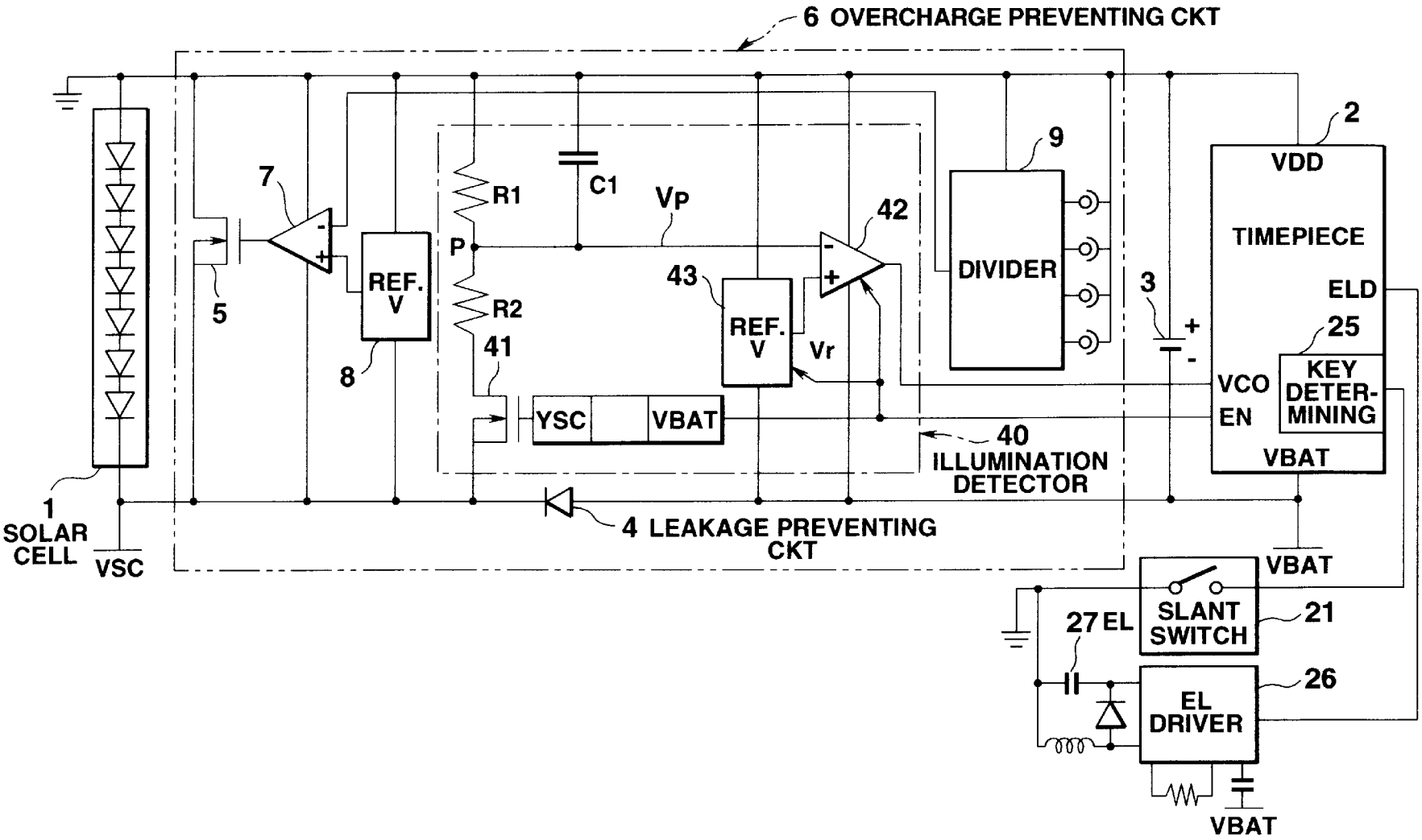
FIG. 3 is a block diagram of an electronic circuit of an electronic wristwatch with a solar cell as a second embodiment of the present invention.

The second embodiment of the present invention will be described next with reference to FIG. 3. The same reference numeral is used to identify similar elements in FIGS. 1–3 and further description thereof will be omitted.

Resistors R1, R2 and a MOS transistor 41 are connected in series with the output terminal of the solar cell 1 with a capacitor C1 connected in parallel with the resistor R1. The resistors R1, R2 and capacitor C1 compose a low pass filter. The junction point P between the resistors R1 and R2 is connected to an inverting input terminal of a comparator 42. A reference voltage Vr from a reference voltage generator 43 which divides an output voltage from a secondary battery 13 to output the reference voltage is fed to a non-inverting input terminal of the comparator 42. The comparator 42 compares a voltage Vp at the junction point P obtained by dividing the output voltage from the solar cell 1 input to the inverting input terminal thereof and the reference voltage Vr input to the non-inverting input terminal thereof. When the voltage Vp at the junction point P is higher than the reference voltage Vr, the output voltage from the comparator 42 or the voltage fed to a terminal VCO of the timepiece 2 becomes low (VSC level). When the voltage at the junction point P is lower than the reference voltage Vr, the voltage output to the VCO terminal of the timepiece 2 becomes high (ground level). The resistors R1, R2, capacitor C1, MOS transistor 41, and comparator 42 compose an illumination detector 40 which detects the illumination of the environment of the solar cell 1. The reason why the illumination detector 40 includes the low pass filter composed of the resistors R1 and R2 and the capacitor C1 is that since the light emitted from the electric light increases and decreases at twice the period of the power supply frequency repeatedly, the output voltage from the solar cell 1 changes at the same period as the light. Thus, when the comparator 42 compares the output voltage from the solar cell 1 and the reference voltage Vr, accurate illumination cannot be detected. In order to avoid this undesirable situation, the voltages Vp at the junction point P are averaged by the low pass filter, the averaged voltage is compared with the reference voltage Vr to measure the illumination accurately.

The operation of the second embodiment will be described next. The timepiece 2 outputs a signal to turn on the MOS transistor 41 at predetermined intervals of time from a terminal EN thereof. When the MOS transistor is turned on, an output voltage from the solar cell 1 is applied across resistors R1, R2, the voltage Vp at the junction point between the resistors R1 and R2 which divides the output voltage from the solar cell 1 is fed to the non-inverting input terminal of the comparator 42.

When the voltage Vp at the junction point P is higher than the reference voltage Vr, the comparator 42 delivers a low level signal to the terminal VCO of the timepiece 12. The voltage Vp and reference voltage Vr are negative ones. When the timepiece 2 receives a low level signal at its terminal VCO, it determines that the absolute value of the output voltage from the solar cell 1 is small and the environment of the solar cell 1 is dark to thereby set the auto light mode which automatically turn on or off the EL element 27 depending on the turning on or off, respectively, of the slant switch 21. When the user performs an act to view the face of his or her wristwatch in this state, a key determining circuit 27 detects that the slant switch 21 is turned on and the timepiece 2 turns on the EL element 27 automatically.

When the voltage Vp at the junction point P is lower than the reference voltage Vr, the comparator 42 delivers a high level signal to the terminal VCO of the timepiece 2. At this time, the timepiece 2 determines that the absolute value of the output voltage from the solar cell 1 is large and the environment of the solar cell 1 is light to cancel the auto light mode. Even when the key determining circuit 25 detects that the slant switch 21 is turned on in this state, the EL element 27 is not turned on.

When the absolute value of the output voltage from solar cell 1 is smaller than a predetermined value, the timepiece 2 determines that the environment of the solar cell 1 is dark to thereby turn on the auto light mode and when the slant switch 21 is turned on, turn on the EL element 27. When the absolute value of the output voltage from the solar cell 1 is equal to, or larger than, the predetermined value, the timepiece 2 determines that the environment of the solar cell 1 is light to thereby cancel the auto light mode. In this case, since the EL element 27 is not turned on even when the slant switch 21 is turned on, wasteful power consumption is prevented and the output energy from the solar cell 1 is effectively used as circuit drive energy. Especially, when the secondary battery 3 is feeding a part of the drive current for the EL element 27, power consumption in the secondary battery 3 is reduced.

While the above embodiment illustrates application of the present invention to the wristwatches with a solar cell, the present invention is applicable to other devices excluding the wristwatches. For example, arrangement may be such that when the user slants an electronic device or its display which is included, for example, in the device along with a solar cell and an illuminator to illumine the display to watch the display, the attitude of the device or display is detected and the illuminator is turned on/off automatically depending on the lightness of the environment.

[Third Embodiment]

A third embodiment of the present invention will be described next with reference to the drawings.

Figure 4:
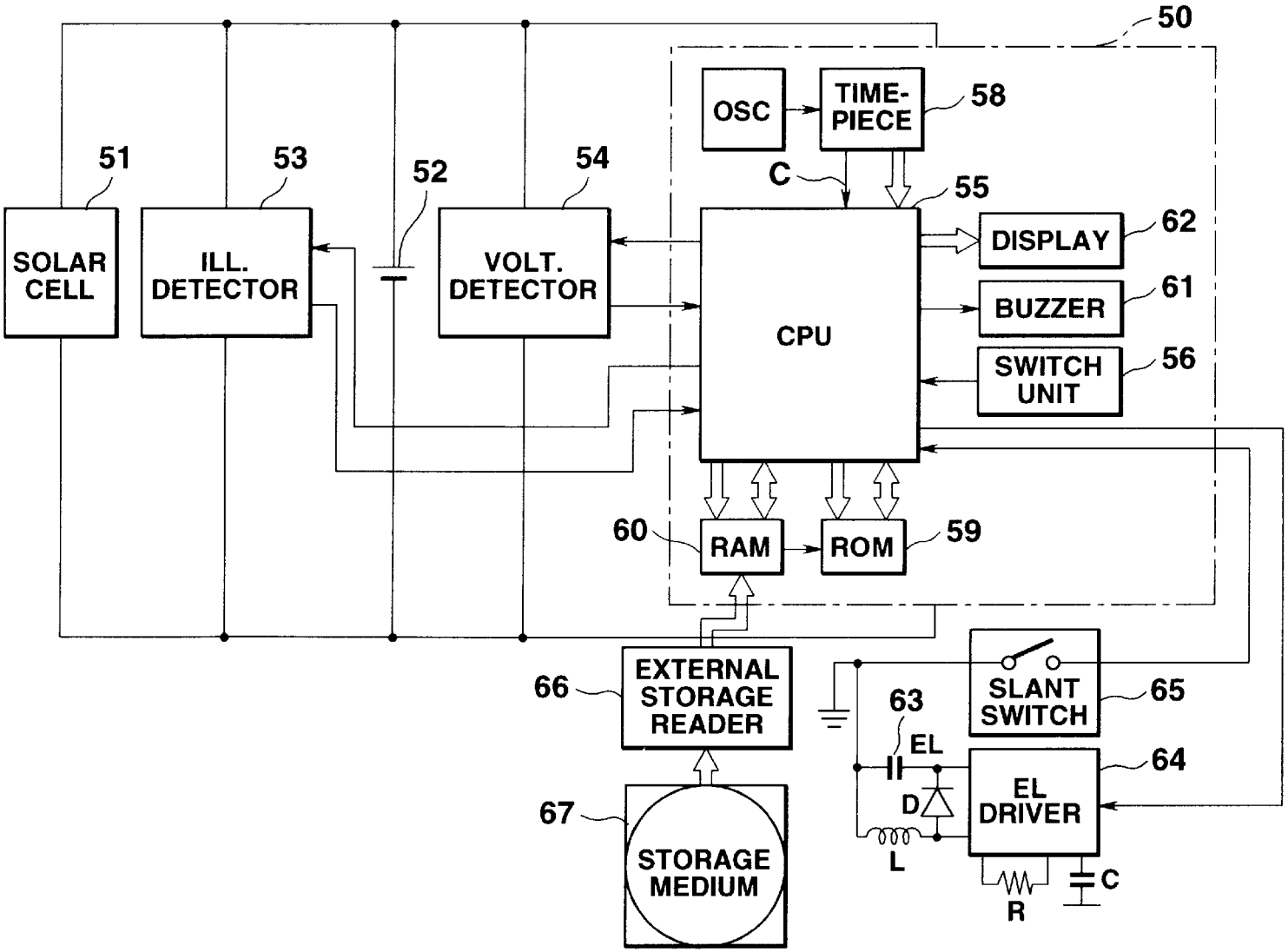
FIG. 4 is a block diagram of an electronic circuit of an electronic wristwatch with a solar cell as a third embodiment of the present invention.

FIG. 4 is a block diagram of an electronic circuit of an electronic wristwatch with a solar cell of the third embodiment. A timepiece circuit 50 of this electronic wristwatch operates based on a secondary battery 52 charged by the power generation of a solar cell 51. An illumination detector 53 is connected to the solar cell 51 to detect its illumination owing to light incident to the solar cell 51 on the basis of the power output from the solar cell. A voltage detector 54 is connected to the secondary battery 52 to detect the level of a supply voltage from the secondary battery 52.

The timepiece circuit 50 includes a CPU 55 which starts up a system program pre-stored in a ROM 59 and controls the respective operations of the circuit elements depending on switch operation signals from a switch unit 56, and a one-minute carrier signal C and time/date recording data received from an oscillator 57 via a timepiece circuit 58. The CPU 55 is connected to the switch unit 56, timepiece circuit 58, ROM 59, a RAM 60, a buzzer 61 and a display unit 62.

The switch unit 56 is provided with a mode switch which selects one of a normal mode and a demonstration mode in the electronic wristwatch, and a plurality of other switches operated to perform various functions such as time adjustment, alarm setting, etc., in the respective operational modes.

In the normal mode, the present date/time data corresponding to recorded date/time data received, for example, from the timepiece circuit 58 is displayed on the display 62. In the demonstration mode, a demonstrative display is performed, for example, to turn on or light up the display 62.

The ROM 59 contains a system program in charge of the whole control of the electronic circuit, subprograms in charge of control depending on the respective operational modes which are the normal and demonstration modes, and preset table data.

The CPU 55 delivers detection control signals to the illumination and voltage detectors 53 and 54, for example, depending on a one-minute carry signal C from the timepiece 58. Data on the illumination level of the solar cell 51 detected by the illumination detector 53 and the output voltage level of the secondary battery 52 detected by the voltage detector 54 are delivered to the CPU 55.

The wristwatch includes an EL element 63 which illumines a display screen of the display 62 and which is driven by an EL driver 64 in accordance with an on/off control signal delivered from the CPU 55.

The electronic wristwatch also includes a slant switch 65 to detect that the timepiece is slanted to a predetermined angle. The slant switch 65 delivers a detection signal indicating this fact to the CPU 55.

The RAM 60 includes a voltage level memory which stores data on one of four predetermined voltage levels "1"–"4" (FIG. 5) to which a power supply voltage detected by the voltage detector 54 each time a one-minute carry signal C is outputted from the timepiece circuit 58 in a normal mode corresponds, a high-load counter memory in which 30-minute time count data is set when a high load as one of the buzzer 61 and the EL 63 is driven, a load point memory in which load points "+10" and "+5" are set when the EL element 63 is turned on and the buzzer 61 is sounded, respectively, in a voltage detection stop period in which count data in the high-load counter memory is being counted, and an illumination level memory which stores data on an illumination level of the solar cell 51 detected by the illumination detector 53 each time a one-minute carry signal C is outputted from the timepiece circuit 58 in the demonstration mode.

If the illumination level detected by the illumination detector 53 and stored in the illumination level memory of the RAM 60 is lower than a predetermined illumination level when the slant switch 65 detects that the wristwatch has an attitude whose slant is larger than a predetermined angle, the EL element 63 is driven by the EL driver 64 for two seconds.

Figures 5, 6:
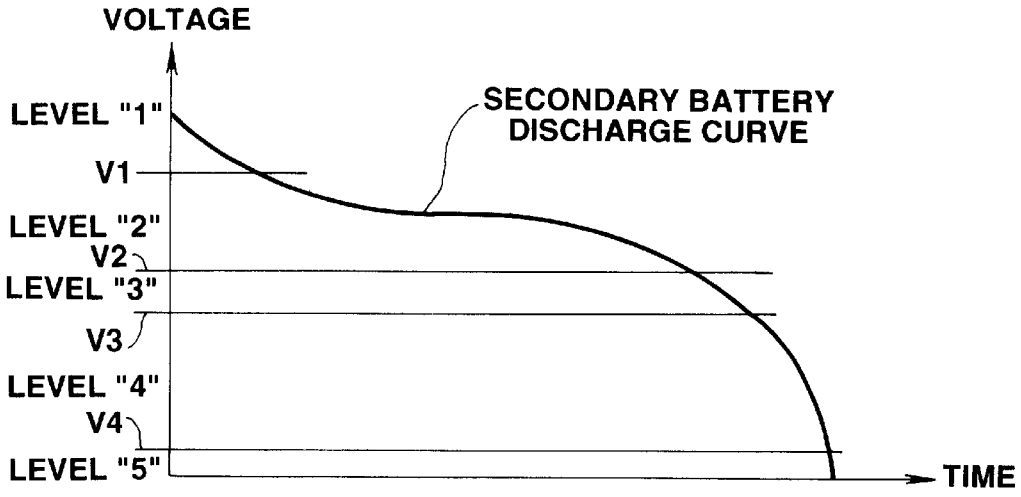
FIG. 5 illustrates a discharging characteristic of a secondary battery of FIG. 4 and a set range of its detection voltage levels.
FIG. 6 shows remaining-secondary-battery-capacity indicator marks depending on detection voltage levels "1"–"4" for the secondary battery and the operating functions for the respective levels.

FIG. 5 illustrates a discharging characteristic of secondary battery 52 in the electronic wristwatch and a set range of its detection voltage level.

When the output voltage level V0 from the secondary battery 52 detected by the voltage detector 54 satisfies a condition $V0 \geqq V1$, $V1 > V0 \geqq V2$, $V2 > V0 \geqq V3$, $V3 > V0 \geqq V4$, or $V4 > V0$ where V1, V2, V3, and V4 are each a voltage level, the CPU 55 determines that the output voltage level V0 is a level "1", "2", "3", "4", or "5", respectively, and stores data on the output voltage level V0 in the voltage level memory of the RAM 60.

FIG. 6 illustrates remaining-secondary-battery-capacity display marks depending on detected voltage levels "1"–"5" of the secondary battery 52 in the wristwatch, and the operating functions for the respective levels.

In a sufficient residual state of the level "1" or "2" where the detected output voltage level of the secondary battery 52 determined by the CPU 55 represents a sufficiently high remaining-secondary-battery capacity, the load operations for all the functions are possible. In a state where the detected output voltage level has dropped to the level "3", driving the buzzer 61 and EL element 63 is inhibited to suppress consumption of the secondary battery 52. In a state where the detected output voltage level has dropped to the level "4", driving the display 60 in addition to the buzzer 61 and the EL element 63 is inhibited to thereby further suppress consumption of the secondary battery 52.

In the states of the levels "3" and "4", a sounding stop alarm in a state where an alarm or a time signal is set is displayed.

In a state where the detected output voltage level has dropped to the level "5", the whole timepiece circuit and hence its operation are stopped.

The detected voltage level of the secondary battery 52 is restored to its original level if charging from the solar cell 51 reopens even when the detected voltage level of the secondary battery 52 has dropped to level "5" (low) due to discharging.

When (1) the high load (the buzzer 61 or EL element 63) is driven, so that 30-minute time count data is set in the high load counter memory of the RAM 60, and (2) the buzzer 61 and EL element 63 are further driven repeatedly in the voltage detection stop period in a time counting operation, so that the load point set in the load point memory reaches "1000", the voltage level data stored in the voltage level memory is forcedly changed to data on level "3" data, driving of the high load is inhibited, and consumption of the secondary battery 52 is suppressed.

The load point set in the load point memory of the RAM 60 is cleared to "0" when the voltage detection stop period expires or when 30 minutes have passed since the last high-load driving operation, so that the time count data in the high load counter memory becomes "0".

The high load point "1000" is a value corresponding to amperage which, in turn, corresponds to a voltage range for the level "3" in the secondary battery 52.

Management of a power supply state of the wristwatch will be described next.

Figure 7:
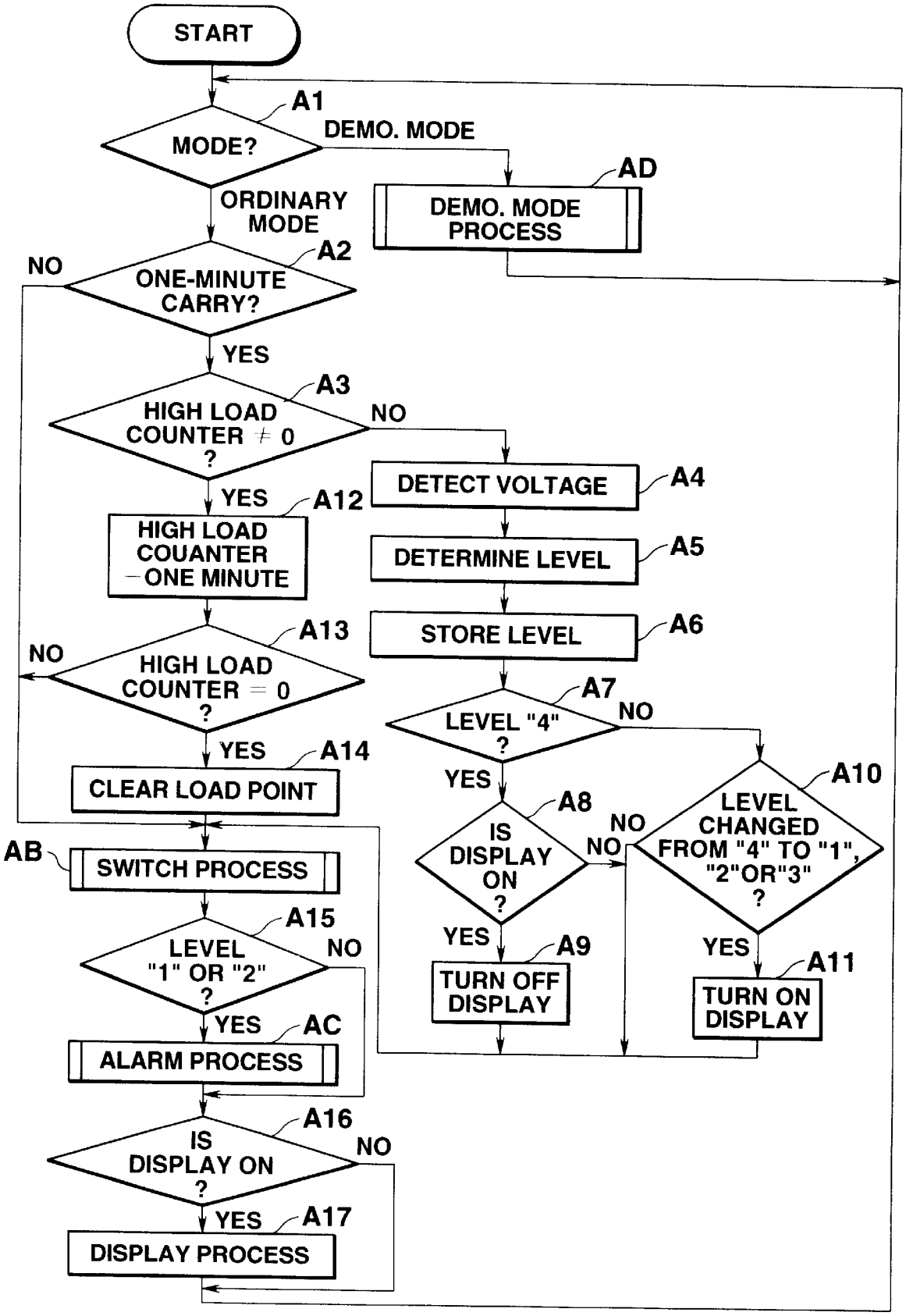
FIG. 7 is a flow chart of a whole process for managing the state of a power supply of the electronic wristwatch of FIG. 4.
Figure 8:
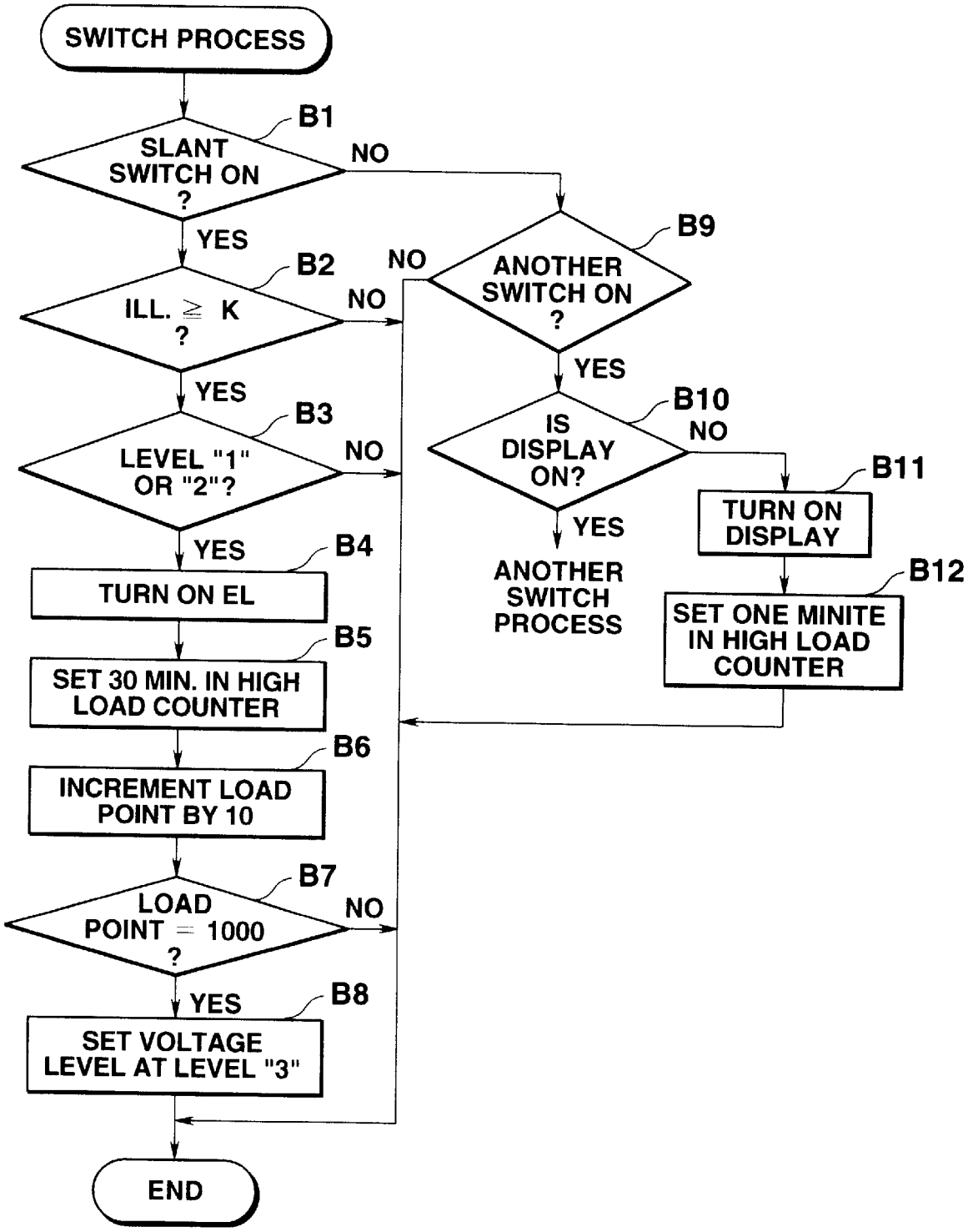
FIG. 8 is a flow chart of a switch process of FIG. 7.

FIG. 7 is a flow chart of a whole process for managing the power supply state of the wristwatch. FIG. 8 is a flow chart of a switch process involved in the management of the power supply state of the wristwatch.

Figure 9:
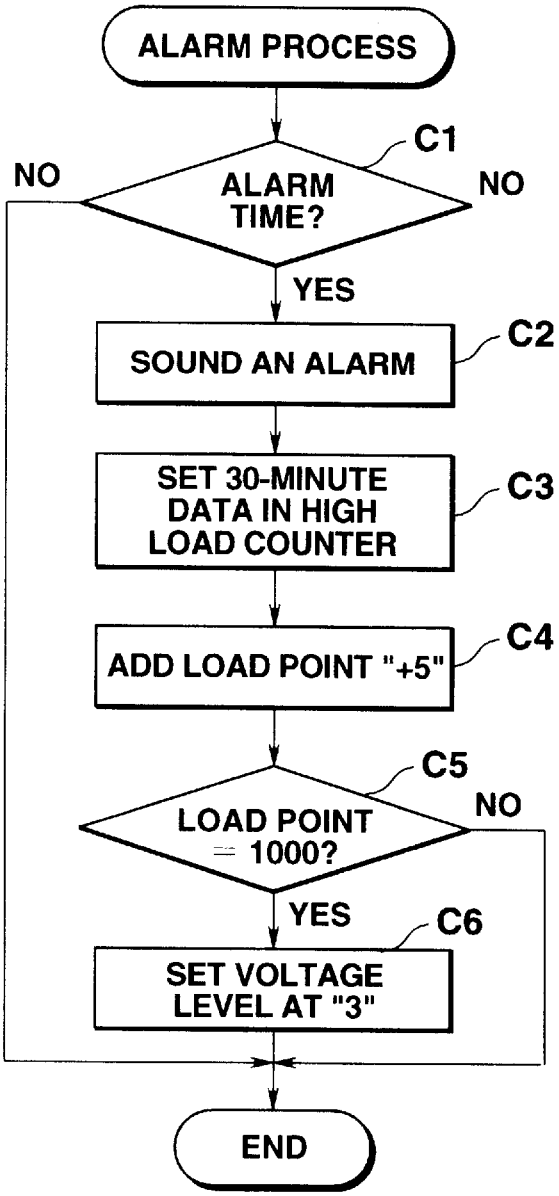
FIG. 9 is a flow chart of an alarm process of FIG. 7.

FIG. 9 is a flow chart of an alarm process involved in the management of the power supply state of the wristwatch.

Figure 10:
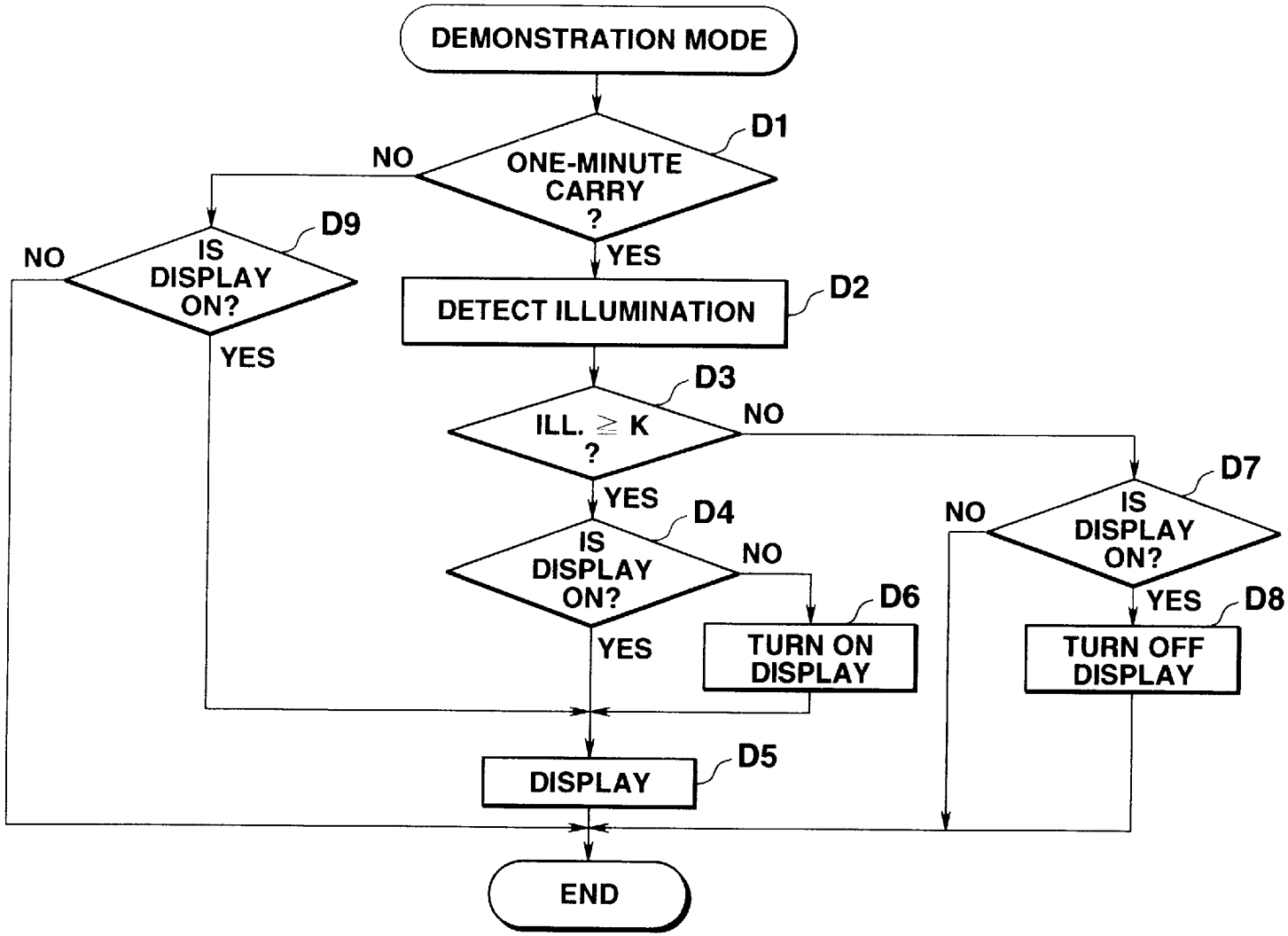
FIG. 10 is a flow chart of a demonstration mode of FIG. 7.

FIG. 10 is a flow chart of a demonstration mode process in the wristwatch.

When the CPU 55 determines that the demonstration mode is set in accordance with the operation of the mode switch of the switch unit 56, the control passes to a demonstration mode process of FIG. 10 (step A1→AD).

When the CPU 55 determines that the normal mode is set in accordance with the operation of the mode switch of the switch unit 56, the CPU 55 further determines whether time count data is set in the high-load counter memory of the RAM 60 or it is now in the voltage detection stop period (step A1→A2→A3).

If not, the voltage detector 54 detects the voltage level of the secondary battery 52. The CPU 55 then detects in which of the voltage ranges for the levels "1"–"4" the detected voltage level is (FIGS. 5 and 6), and stores data on that voltage level in the voltage level memory of the RAM 60 (step A3→A4→A5→A6).

When the detected voltage level of the secondary battery 52 is in a voltage range for the level "1" or "2", the CPU 55 determines that the detected voltage level is not level "4" and that the detected voltage level is not a change from the level "4" to the level "1", "2" or "3". The CPU then shifts its control to a switch process of FIG. 8, an alarm process of FIG. 9 and then a display process of FIG. 7 (step A7→A10→AB→AC→A17).

During a period in which the timepiece circuit 58 outputs no one-minute carry signal C, the CPU 55 then directly shifts its control to the switch process of FIG. 8, the alarm process of FIG. 9, and then the display process (step A2→AB→AC→A17).

As described above, each time the timepiece circuit 58 outputs a one-minute carry signal C, the CPU 55 detects an output voltage from the secondary battery 52. When the user slants the wristwatch, for example, to a predetermined angle or more to watch the time displayed on the display 62 in a state where the detected voltage level is the level "1" or "2", the CPU 55 determines that the slant switch 65 has been turned on in the switch process of FIG. 8 and determines whether the illumination level of the wristwatch based on irradiation of light and detected by the illumination detector 53 is below a predetermined illumination k (step B1→B2).

In this case, when the CPU 55 determines that the user's environment is dark and the illumination level of the wristwatch is below the predetermined illumination, it further determines whether or not the detected voltage level stored in the voltage level memory of the RAM 60 is the level "1" or "2". If the CPU 55 determines that the detected voltage level is the level "1" or "2", the E1 driver 64 turns on the EL element 63 to illumine the time displayed on the display unit 62 (step B2→B3→B4).

In the turning-on operation of the EL element 63, the load on the secondary battery 52 is high and its voltage level greatly drops temporarily, so that the CPU does not determine the level of the detected voltage for 30 minutes which is a criterion in which the cell voltage recovers. To this end, 30-minute time count data is set in the high load counter memory of the RAM 60 (step B5).

Simultaneously, a load point "+10" equivalent to amperage required for a 2-second turning-on operation of the EL element 63 is added in the load point memory of the RAM 60 (step B6).

The CPU 55 then determines whether the load point set in the load point memory has reached "1000". If not, the CPU terminates this switch process and shifts its control to the alarm process of FIG. 9 and then the display process of FIG. 7 (step B7→AC→A17).

When the CPU 55 determines on the basis of date/time data obtained from the timepiece circuit 58 in the alarm process of FIG. 9 that an alarm time set by the user is reached, the buzzer 21 is driven to sound an alarm, and as in the case where the EL element 63 was turned on, 30-minute time count data is set in the high load counter memory of the RAM 60 (step C1→C2→C3).

Simultaneously, a load point "5" equivalent to amperage required for sounding the buzzer 61 for two seconds is added in the load point memory of the RAM 60 (step C4).

The CPU 55 then determines whether the load point set in the load point memory has reached "1000". If not, the CPU 55 terminates this alarm process and shifts its control to the display process (step C5→A17).

As described above, when 30-minute time count data is set in the high load counter memory, the CPU determines that the count data in the high load counter is not "0", but it is now in the voltage detection stop period when the timepiece circuit 58 is determined to have output a one-minute carry signal C. Thus, the CPU decrements the count data one minute by one minute for 30 minutes until the CPU determines that the count data becomes "0". The CPU 55 then shifts its control repeatedly to the switch process of FIG. 8, the alarm process of FIG. 9, and then the display process while the voltage detection stop state continues (step A2→A3→A12→A13→AB→AC→A17).

When the CPU 55 determines at step A13 that the count data in the high load counter memory becomes "0", and that the voltage detection stop period has expired, the load point set in the load point memory is cleared to "0" (step A13→A14), whereupon the CPU reopens the detection, determination, and storage of the voltage level of the secondary battery 52 at the output timing of the next one-minute carry signal C (step A2→A3→A4→A5→A6).

If the high load is again driven, that is, the EL element 63 is turned on or the buzzer 21 is sounded before the time count data set in the load count memory of the RAM 60 becomes "0" or in the voltage detection stop period, new 30-minute time count data is set in the high load counter memory (step B5 or C3), and the voltage detection stop period is extended further for 30 minutes from this time point. Simultaneously, the load point set in the load point memory is added further by "10" in the case of driving the EL element 63 (step B6) and by "5" in the case of driving the buzzer 61 (step C4).

When the CPU 55 determines that after the EL element 63 has been many times turned on or the buzzer 61 has been many times sounded at interval of time less than 30 minutes, the load point accumulated in the load point memory has reached "1000", it changes the voltage level data set in the voltage level memory of the RAM 60 is changed to and set at level "3" (step B5→B8 or step C5→C6).

Then, in the switch process of FIG. 8, when the CPU determines that the slant switch 65 is turned on, and then determines that the illumination level is below the predetermined illumination level, but not the level "1" or "2", it inhibits turning on the EL element 63 to suppress consumption of the secondary battery 52 (step B1→B2→B3→END). When the CPU 55 further determines in a voltage level determining process (step A15) continuing from the switch process (AB) that the illumination level is not the level "1" or "2", it also inhibits driving the buzzer 61 in the alarm process to suppress consumption of the secondary battery 52 (step A15→A16).

Thereafter, the consumption of the secondary battery 52 further proceeds, and the voltage detector 54 detects the output voltage of the secondary battery 52 (step A4), the CPU 55 determines the level (step A5). When the CPU then determines that the voltage level stored in the voltage level memory (step A6) has dropped to the level "4", the CPU 55 determines whether the display 62 has been turned on. If so, the CPU 55 inhibits turning on of the EL element 63, sounding the buzzer 61, as well as turning on the display 62 to thereby suppress consumption of the secondary battery 52 (A7→A8→A9).

At this time, when the switch unit 56 is operated, the display 62 is turned on and one-minute time count data is set in the high load counter memory of the RAM 60 so that the CPU 55 does not shift its control to the voltage detecting process when the next one-minute carry signal is output (step B9→B10→B12).

Thus, when the next first one-minute carry signal C is outputted from the timepiece circuit 58, the CPU 55 determines that the time count data in the high load counter memory is not "0". Thus, the CPU does not shift its control to the voltage detecting process, but decrements the time count data by one. Thus, the CPU determines that the time count data has become "0", and then clears the load point (step A2→A3→A12→A13→A14).

Thus, when the next one-minute carry signal C is outputted from the timepiece circuit 58 (step A2), the CPU shifts its control to voltage detection, determination, and storage processes (steps A4–A6). When the CPU 55 then determines that the detected voltage level of the secondary battery 52 is the level "4" (step A7) and then that the display unit 62 has been operated, the CPU 55 turns off the display unit 62 (steps A8→A9). That is, if the switch is operated when the detected voltage level of the secondary battery 52 is the level "4", the display unit 62 is driven for a minimum required time of one or more minutes but less than two minutes.

Thereafter, the solar cell 51 reopens charging the secondary battery 52. The CPU then performs the voltage detection process involving the determination of the outputting of a one-minute carry signal C (step A3→A6). When the CPU 55 then determines that the detected voltage level has returned from level "4" to level "3", it starts to turn on the display 62 which has stopped so far (step A7→A10→A11).

If the CPU determines that the wristwatch operation mode has been changed to the demonstration mode (step A1→AD), and then that timepiece circuit 58 has output a one-minute carry signal C in the demonstration mode process of FIG. 10, the CPU determines whether the illumination level detected by the illumination detector 53 and stored in the illumination data memory of the RAM 60 is above the predetermined level k, that is, whether the wristwatch is, for example, on display in the shopwindow or put in store (step D1→D2→D3).

When the CPU 55 determines that the brightness is above the predetermined illumination k, and that the wristwatch is on display in the shop window display, but that the display 62 has not been turned on, the CPU drives the display 62 to perform the demonstration process (step D3→D4→D6).

When the CPU determines that the illumination level detected by the illumination detector 53 and stored in the illumination data memory of the RAM 60 is not above the predetermined illumination k because the shop window display of the wristwatch has, for example, ended and the shop is closed or the wristwatch is put in store, and that the display 62 has been turned on, the CPU 55 stops the turning on of the display unit 62 to suppress consumption of the secondary battery 52 (step D3→D7→D8).

When the display 62 has been turned on in the period where no one-minute carry signal is output, the demonstration process continues (step D1→D9→D5). When the turning on of the display 62 has stopped, this state continues (step D1→D9→END).

Thus, according to the inventive electronic wristwatch, not only an alarm is displayed using the remaining-secondary-battery capacity display mark (FIG. 6) in accordance with data on the voltage level of the secondary battery 52 detected by the voltage detector 54, but also driving of the EL element 63 and buzzer 21 is inhibited to suppress consumption of the secondary battery 52 by the high load when the detected voltage level drops to level "3". When the detected voltage level further drops to level "4", driving of the display unit 62 is additionally inhibited to thereby suppress power consumption of the battery to a minimum. Thus, the user can surely know the degree of consumption of the secondary battery 52 or its service life depending on the state of the timepiece operation to thereby prevent the whole timepiece circuit from stopping suddenly without pervious notice.

According to the inventive wristwatch, each time the EL element 63 or buzzer 61 is driven, the voltage detecting process for the secondary battery 52 is stopped again for 30 minutes. Each time the EL element 63 or buzzer 61 is further driven in this voltage detection stop period, load points corresponding to the consumed amperage required for driving the load are accumulated. When the accumulated point reaches "1000" corresponding to the amperage for the voltage range of the voltage level "3", the voltage level data stored in the voltage level memory of the RAM 60 is forcedly changed to the level "3", driving of the EL element 63 and buzzer 61 is inhibited to suppress consumption of the secondary battery 52 by the high load. Thus, even when accurate voltage level detection cannot be performed by driving the high load, a drop in the detected voltage level to the level "3" is determined by accumulation of the amperage consumed for load driving, driving the high load is inhibited, and the battery's service life is securely reported to the user.

According to the inventive electronic wristwatch, when the timepiece is slanted over a predetermined angle to thereby turn on the slant switch 65, and only when the illumination level detected by the illumination detector 53 is below the predetermined illumination, the EL element 63 is turned on by the EL driver and the display data on the display unit 62 is illumined. Thus, only when the user desires to watch display data, for example, on the time, but cannot watch it because of darkness, the displayed data is automatically illumined and wasteful turning on of the EL element 63 is prevented to suppress consumption of the secondary battery 52.

According to the inventive electronic wristwatch, when the illumination level detected by the illumination detector 53 is above the predetermined illumination in the demonstration mode, the display unit 62 is turned on to thereby perform a demonstrative display. When the illumination level is below the predetermined illumination, the turning on of the display unit 62 is stopped to terminate the demonstration display. Thus, automatic efficient selection is possible between demonstrative display of the wristwatch in the shop window and non-display of the wristwatch in the closed shop or put-in-store state, so that consumption of the secondary battery 52 is suppressed to a minimum before it is shipped and sold.

While in the third embodiment, it is illustrated that driving of the EL element 63 and buzzer 61 is inhibited when the detected voltage level of the secondary battery 52 is the level "3", and that turning on of the display is further inhibited when the detected voltage level is the level "4", an inhibited combination of high loads depending on the detected voltage level is not limited.

While in the third embodiment the amperage consumption involved in the driving of the EL element 63 and buzzer 61 is illustrated as counted as load points, arrangement may be solely such that the number of times of turning on the EL element 63 or the number of times of sounding the buzzer 61 is counted.

[Fourth Embodiment]

A fourth embodiment of the present invention will be next with reference to the drawings.

Figure 11:
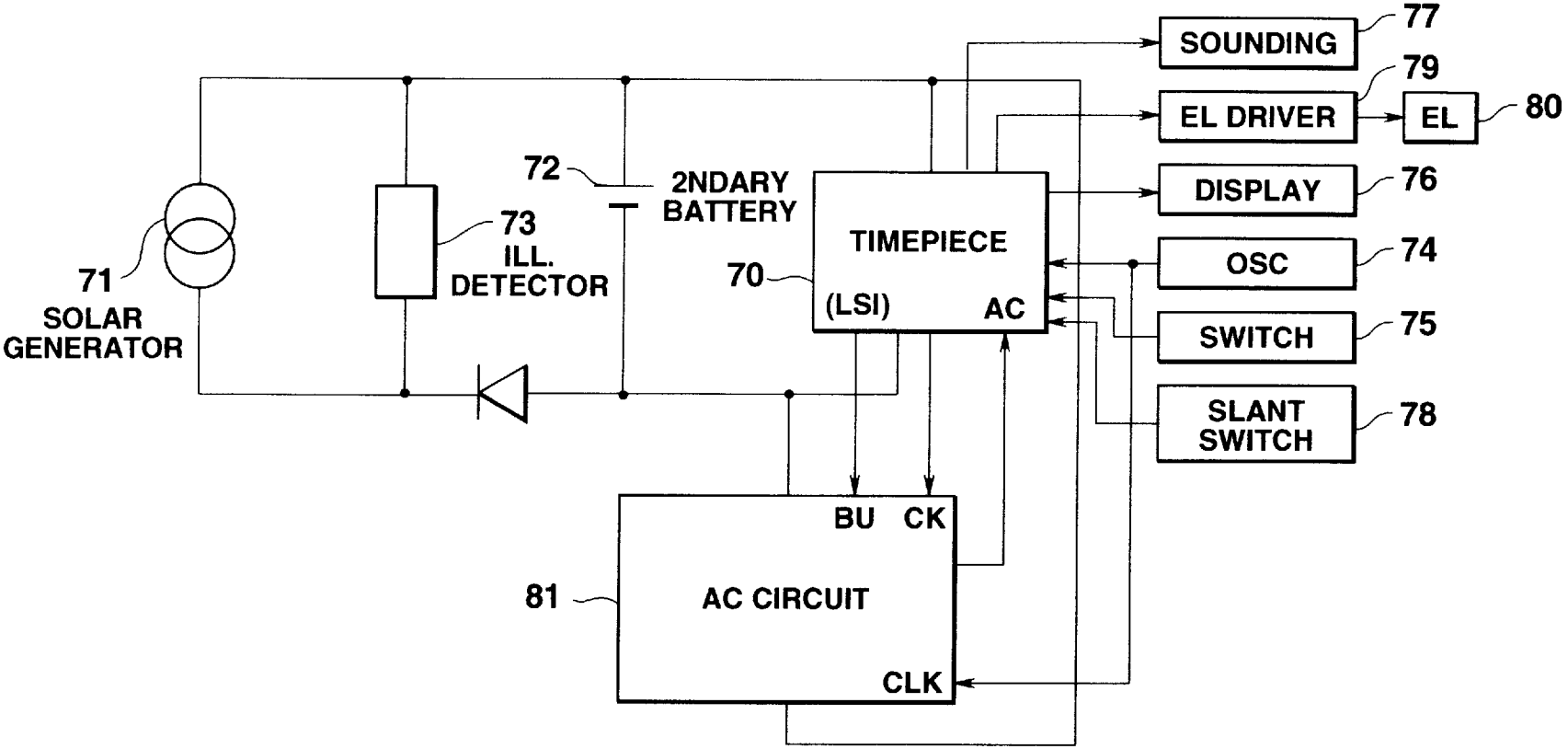
FIG. 11 is a block diagram of an electronic circuit of an electronic wristwatch with a solar cell as a fourth embodiment of the present invention.

FIG. 11 is a block diagram of an electronic wristwatch with a solar cell of the embodiment. This wristwatch includes a timepiece LSI 70, which includes a CPU, ROM, and RAM (none of which are shown) and controls the operation of the respective elements in accordance with a system program pre-stored in the ROM. A power supply input terminal of the timepiece LSI 170 is connected to a secondary battery (VBAT) 72 charged by the power generation of a solar generator 71.

An illumination detector 73 and a reverse current preventing diode 74 are connected between the solar generator 71 and the secondary battery 72. The wristwatch also includes an oscillator 74 which outputs an oscillation signal, for example, of 32 kHz as a basic clock signal CLK which actuates the timepiece LSI 70, a switch 75 which performs time setting, alarm setting, timer setting, and mode changing operations, a display unit 76 composed of a liquid crystal display which performs display operations depending on the respective operational modes, and a sounding unit 77 which produces a time signal or sounds an alarm such as a buzzer.

Those elements are all connected to the timepiece LSI 70.

The wristwatch also includes a slant switch 78 which delivers a slant detection signal representing a slant of the wristwatch to the timepiece LSI 70. The wristwatch further includes an EL element 80 which illumines the display unit 76 and an EL driver 79 which drives the EL element. Like the above embodiments, when the slant switch 78 is turned on and the illumination detector 73 detects an illumination below a predetermined illumination, the EL 80 is turned on by the EL driver 79.

The wristwatch further includes an AC circuit 81 which delivers a power supply voltage Vbat fed by the secondary battery 72 to the timepiece LSI 70, a basic clock signal CLK output by the oscillator 74, and an all-clear (initialize) signal AC fed to the timepiece LSI 70 in accordance with a divided pulse signal BU and a clock signal CK output from the timepiece LSI 70 on the basis of the basic clock signal CLK.

When the power supply voltage of the secondary battery 72 drops to a predetermined voltage level slightly higher than a lower limit of the operation voltage of the timepiece LSI 70, for example, due to insufficient charging from the solar generator 71, the AC circuit 81 starts to deliver the all-clear signal AC to the timepiece LSI 70, and continues to deliver this all-clear signal AC to the timepiece LSI 70 until a predetermined time elapses after the power supply voltage of the secondary battery 72 has reached the starting voltage for the oscillating operation of the oscillator 74, for example, due to the recovery of charging from the solar generator 71.

The oscillation starting voltage of the oscillator 74 is set so as to be higher than the predetermined voltage level detected by the AC circuit 81, and the oscillation stopping voltage is set with a hysteresis characteristic in which it is lower than the lower limit of the operating voltage of the timepiece LSI 70 and higher than the operating voltage of a CMOS-HC.

Figure 12:
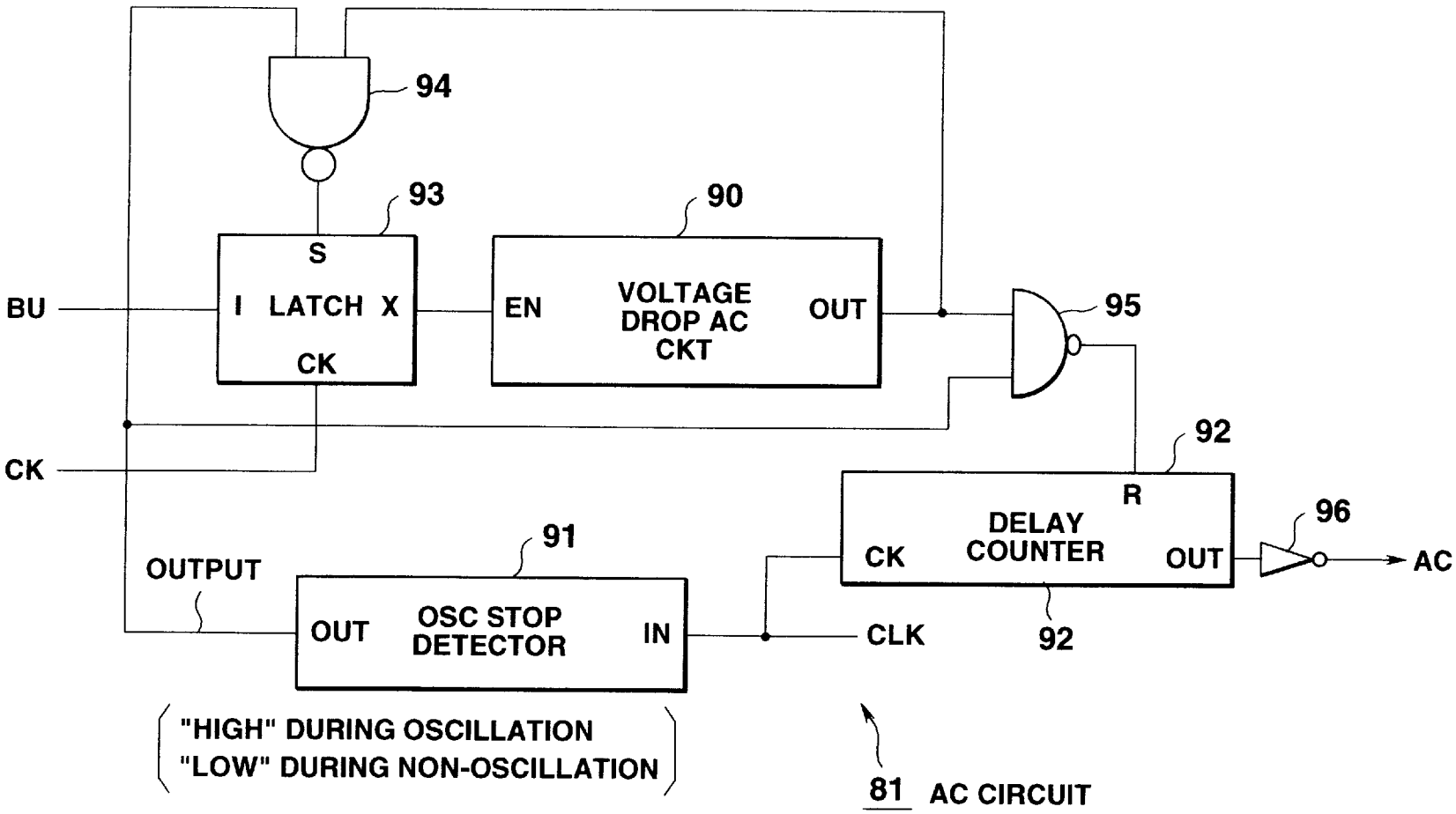
FIG. 12 is a block diagram of an AC circuit of the block diagram of FIG. 11.

FIG. 12 is a block diagram of the AC circuit 81 of the wristwatch, which includes a combination of a latch 93, a voltage drop AC circuit 90, an oscillation stop detector 91, a delay counter 92, two NAND gates 94, 95, and an invertor 96.

The latch 93 receives at its set terminal S an output signal from the NAND gate 94; at an input terminal I a divided pulse signal BU from the timepiece LSI 70; and at a clock terminal CK an operation clock signal CK from the timepiece LSI.

The latch 93 outputs from its output terminal X an enable signal to an input terminal EN of the voltage drop AC circuit 90 whose output signal OUT is delivered from its output terminal OUT to a first terminal of the NAND gate 94 and to a first terminal of the NAND gate 95.

The oscillation stop detector 91 receives at its input terminal IN a basic clock signal CLK from the oscillator 74, and delivers an output signal from its terminal OUT to a second terminal of each of the NAND gates 94 and 95.

The output signal from the NAND gate 95 is delivered to a reset terminal R of the delay counter 92, which receives at its counter clock terminal CK a basic clock signal CLK from the oscillator 74. The delay counter 92 provides an output signal from its output terminal OUT as the all-clear signal AC via an invertor 96 to the timepiece LSI 70.

The delay counter 92 counts basic clock signals CLK delivered to its clock terminal CK for a predetermined time since the output signal from the NAND gate 95 changes from high to low to stop delivery of a reset signal R to change the counter output signal at the output terminal OUT from low to high and also change the all-clear signal AC from high to low.

Figure 13:
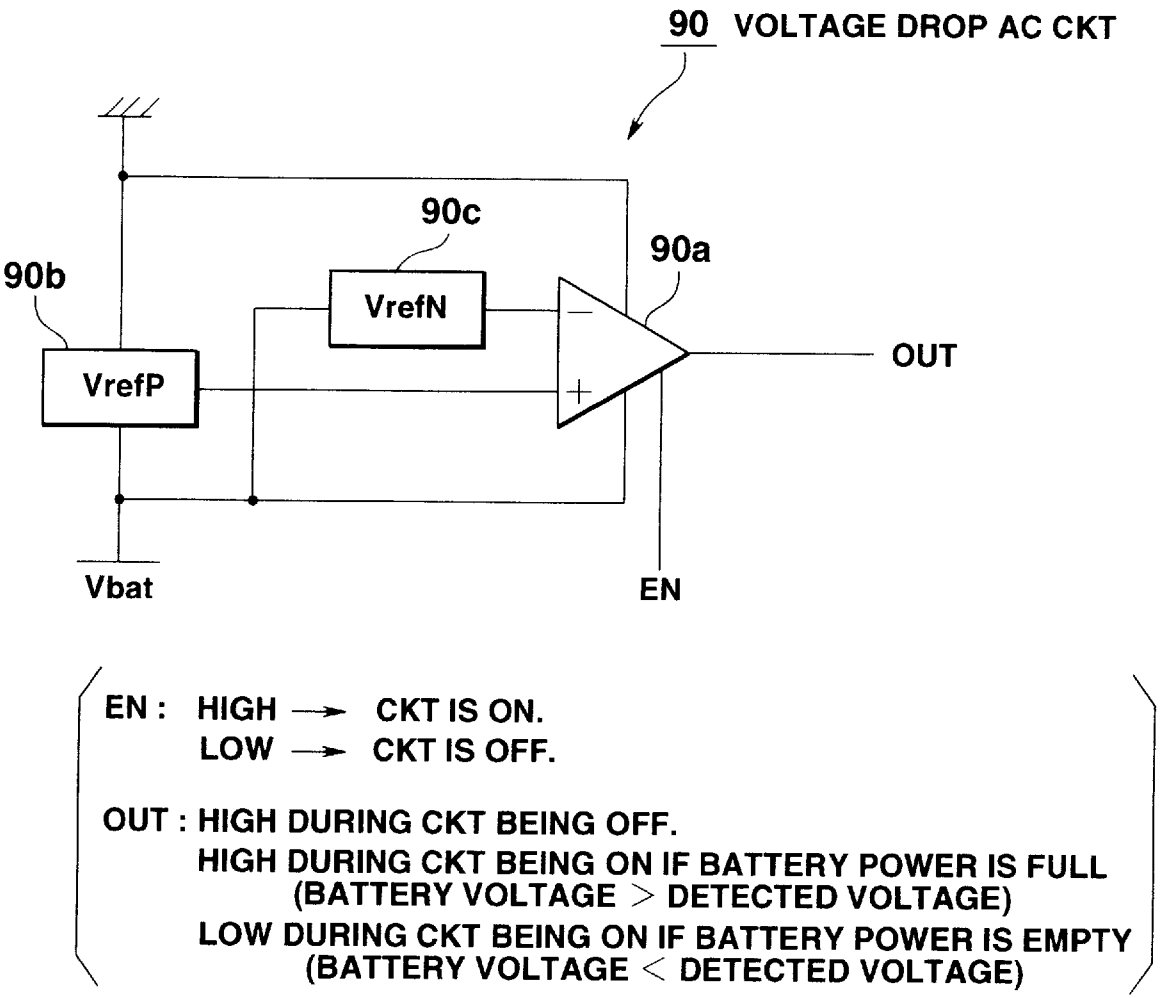
FIG. 13 is a diagram of a voltage drop AC circuit of the AC circuit of FIG. 12.

FIG. 13 is a diagram of the voltage drop AC circuit 90 of the AC circuit 81 of the wristwatch. The voltage drop AC circuit 90 includes a comparator 90*a* and a pair of reference voltage setting units 90*b* and 90*c*. The voltage drop AC circuit 90 outputs a high output signal when an enable signal EN fed from the output terminal X of the latch 93 is low and the comparator 90*a* is off.

When the enable signal N is high and the comparator is on, and when the power supply voltage Vbat of the secondary battery 72 is higher and lower than a predetermined voltage level, respectively, the comparator's output signal becomes high and low, respectively.

Figure 14:
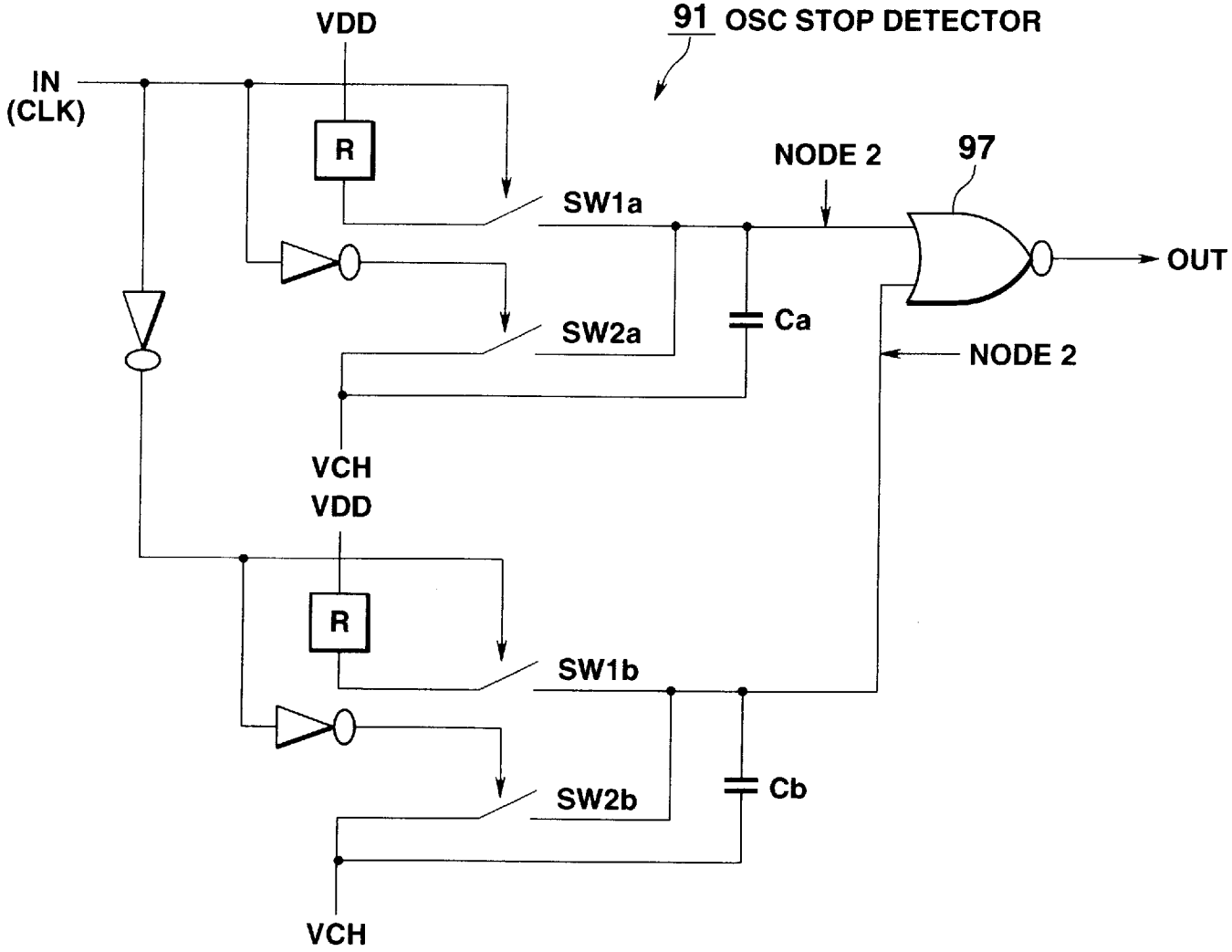
FIG. 14 is a diagram of an oscillation stop detector of the AC circuit of FIG. 12.

FIG. 14 is a circuit diagram of the oscillation stop detector 91 of the AC circuit 81 of the wristwatch.

The oscillation stop detector 91 includes a pair of switches SW1*a* and SW2*a* provided between an input terminal IN thereof and a node 1 of a NOR gate 97 provided at an output terminal thereof and turned on alternately depending on the period of a basic clock signal CLK having 32 kHz supplied from the oscillator 74 to the input terminal IN, and another pair of switches SW1*b* and SW2*b* provided between the input terminal IN and a node 2 of the NOR gate 97 so as to perform a reverse operation to that of the switches SW1*a* and SW2*a*. The switches SW1*a* and SW1*b* are each connected via a high resistor R to VDD. The switches SW2*a* and SW2*b* are also connected in parallel with capacitors Ca and Cb, respectively.

During the oscillation in which the oscillator 74 is delivering the basic clock signal CLK to the input terminal IN of the oscillation stop detector 91, the two switches SW1*a* and SW2*a* turn on alternately, and the other two switches SW1*b* and SW2*b* also turn on alternately. Since the switches SW1*a* and SW1*b* on the VDD side are each connected in serial with the high resistor R, the nodes 1 and 2 are each placed at substantially the VCH level ("low") and the output signal from the output terminal OUT of the NOR gate 97 becomes high.

In an oscillation stop state where no basic clock signal CLK is fed from the oscillator 74 to the input terminal 1N, there are two different cases in which the input terminal IN is fixed to a high and a low level, respectively. In the former case where the input terminal IN is fixed to the high level, the switches SW1*a* and SW1*b* are on and off, respectively, and the switches SW2*a* and SW2*b* are off and on, respectively. Thus, the node 1 is charged to the VDD level (high) whereas the node 2 is placed at the VCH level (low), and hence the output signal from the NOR gate 97 becomes low.

In the latter case where the input terminal IN is fixed to the low level, the node 1 is placed at the VCH level (low) and the node 2 at the VDD level (high), and the output signal from the NOR gate 97 becomes similarly low, which is a completely reverse operation to that of the former case.

An outputting operation of an all-clear (initialize) signal AC involved in fluctuations of the power supply voltage of the wristwatch will be described next.

Figure 15:
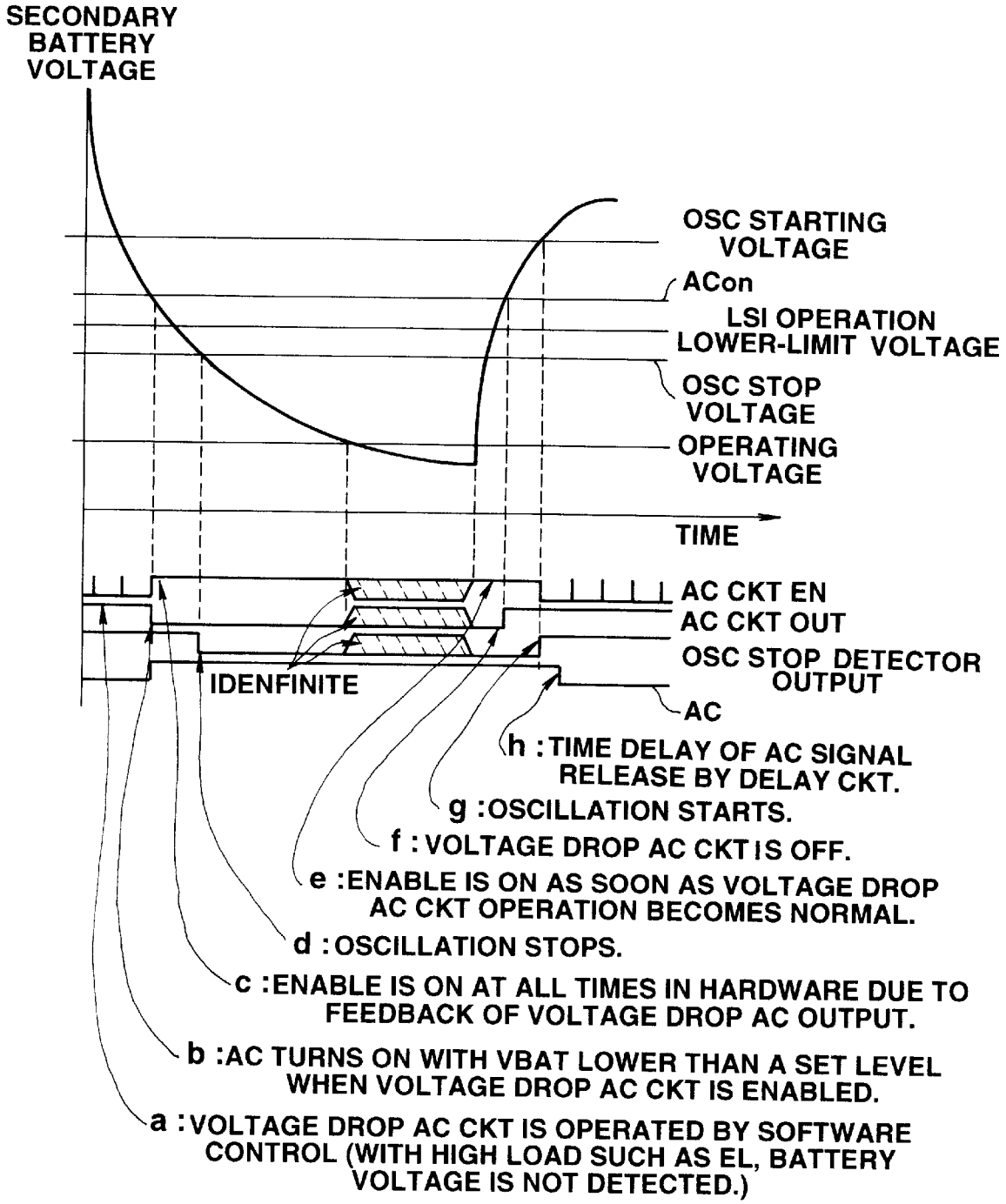
FIG. 15 is a timing chart of the outputting operation of an all-clear (initialize) signal AC involving fluctuations of the power supply voltage.

FIG. 15 is a timing chart of the outputting operation of an all-clear (initialize) signal AC involving fluctuations of the power supply voltage.

Figure 16:
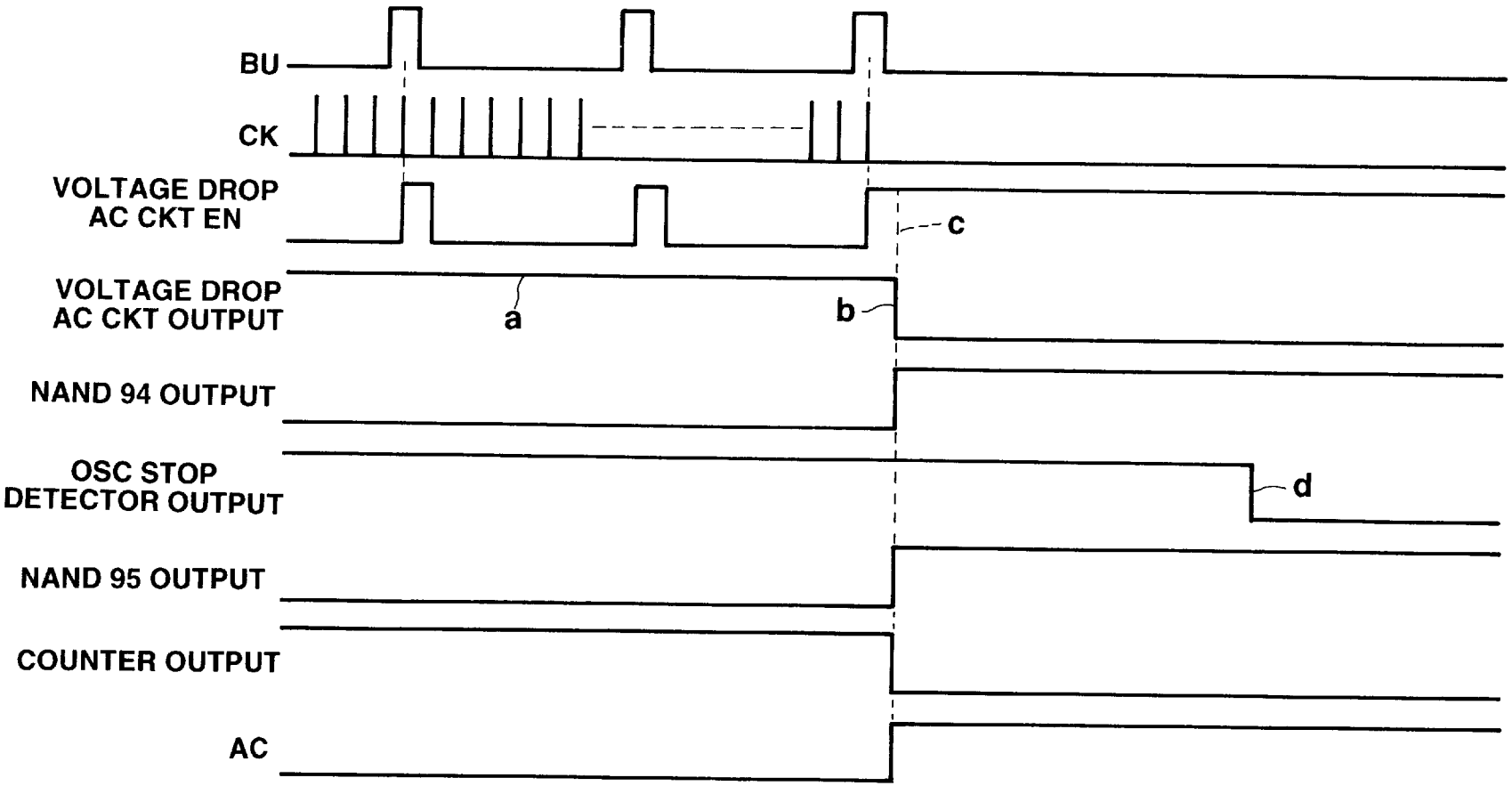
FIG. 16 is a timing chart of the outputting operation of the all-clear (initialize) signal AC in a drop in the power supply voltage.

FIG. 16 is a timing chart of the outputting operation of the all-clear (initialize) signal AC in a drop in the power supply voltage.

Figure 17:
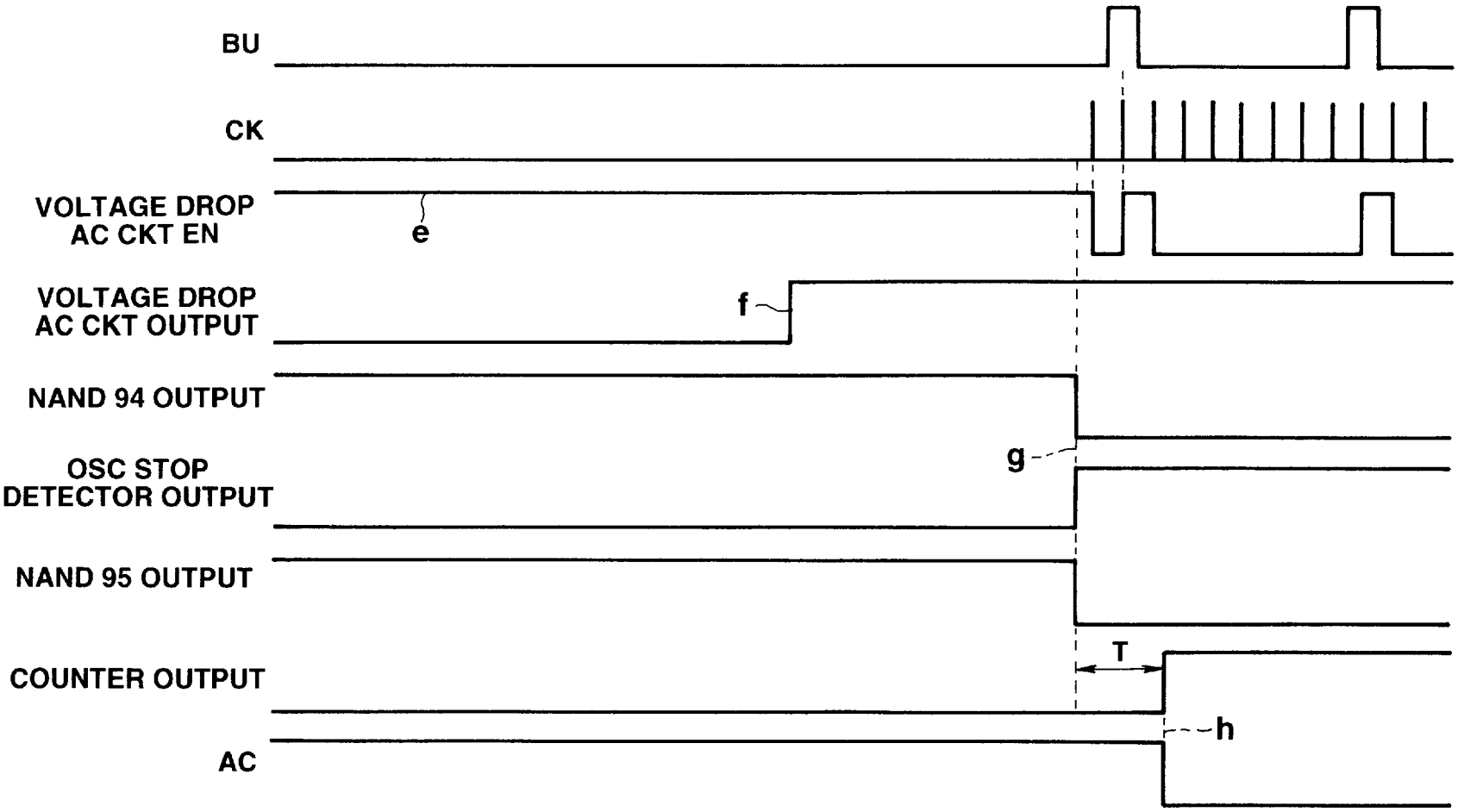
FIG. 17 is timing chart of the outputting operation of an all-clear (initialize) signal AC in a rise in the power supply voltage.

FIG. 17 is timing chart of the outputting operation of the all-clear (initialize) signal AC in a rise in the power supply voltage.

First, when the power supply voltage Vbat of the secondary battery 72 is higher than a predetermined voltage detection level of the voltage drop AC circuit 90, a divided pulse signal BU output by the timepiece LSI 70 is latched by the latch 93 of the AC circuit 81 in accordance with an operation clock signal CK output by the timepiece LSI 70, and the output terminal X of the latch 93 delivers an enable signal EN synchronized with the divided pulse signal BU to the voltage drop AC circuit 90.

In this case, the output signal from the voltage drop AC circuit 90 is maintained high (timing a) even when the enable signal EN is low and the comparator is off or even when the enable signal EN is high and the comparator is on, as shown in FIG. 13.

In this case, the output signal from the oscillation stop detector 91 remains high because the oscillator is operating. Thus, each of the NAND gates 94 and 95 output a low signal.

When, for example, no light enters the solar generator 71, the secondary battery power supply 72 is insufficiently charged. Thus, when the power supply voltage Vbat of the second cell 72 gradually lowers and comes below the predetermined voltage detection level in the voltage drop AC circuit 90, the output signal from the voltage stop AC circuit 90 changes from high to low in accordance with an enable signal EN output by the latch 93, and both the outputs from the NAND gates 94 and 95 change from low to high (timing b).

By this operation, the delay counter 92 is supplied with a high reset signal R from the NAND gate 95, the output signal from the delay counter 92 changes from high to low, and the all-clear signal AC changes from low to high.

In this case, the output from the NAND gate 94 remains high, and the latch 93 remains set. Thus, the enable signal EN in the voltage drop AC circuit 90 continuously remains high (timing c).

When the power supply voltage Vbat of the secondary battery 72 drops below the oscillation stop voltage of the oscillator 74, the output signal from the oscillator stop detector 91 is changed to low, which is equal to the level of the output signal C during stoppage of the oscillation (timing d).

Thereafter, when the power supply voltage Vbat of the secondary battery 72 further drops below the operation voltage of the CMOS-IC, the enable signal EN in the voltage drop AC circuit 90, its output signal and the output signal from the oscillation stop detector 91 become indefinite. At this time, when, for example, the solar generator 71 reopens charging the secondary battery 72, and the power supply voltage Vbat is restored to a voltage above the operation voltage of the CMOS-IC, the output signal from the voltage drop AC circuit 90 remains low, and the output signal from the NAND gate 95 remains high since the output from NAND gate 94 becomes high, and the enable signal EN output from the latch 93 remains high. Thus, the all-clear (initialize) signal AC output via the invertor 96 from the delay counter 92 remains high (timing e).

When the power supply voltage Vbat of the secondary battery 72 further increases to the predetermined voltage detection level in the voltage drop AC circuit 90, the output signal from the voltage drop AC circuit 90 changes from low to high (timing f).

Thereafter, when the power supply voltage Vbat further increases to be restored to the oscillation starting voltage of the oscillator 74, the output signal from the oscillator stop detector 91 changes from low to high, the output signals from the NAND gates 94 and 95 change from high to low, the timing at which the enable signal EN fed from the latch 93 to the voltage drop AC circuit 90 is generated changes depending on the divided pulse signal BU and operation clock signal CK output from the timepiece LSI 70, and the reset signal R from the delay counter 92 is changed from high to low. Thus, a predetermined number of basic clock signals CLK (for a predetermined time T) starts to be counted (timing g).

When the counting operation by the delay counter 92 for the predetermined time T from the time when the normal operation of the timepiece LSI 70 is starts due to the start of oscillation of the oscillator 74 is performed and then ends, its counter output signal changes from low to high, the all-clear signal AC changes high to low (timing h).

Thus, the all-clear (initialize) signal AC to the timepiece LSI 70 is maintained until the predetermined time T has elapsed after the power supply voltage Vbat of the secondary battery 72 is restored to the operation voltage of the timepiece LSI 70 and then to the oscillation voltage of the oscillator 74, and the all-clear signal AC is then released so as to recover normal oscillation securely.

Thus, in this wristwatch, when the power supply voltage Vbat of the secondary battery 72 drops to a voltage lower than the operation voltage of the timepiece LSI 70, for example, due to insufficient charging, to stop the circuit operation completely, and then when the solar generator 71 reopens charging, the power supply voltage Vbat returns to the operational voltage of the timepiece LSI 70 and then further to the voltage at which the oscillator 74 starts to oscillate to generate a basic clock signal CLK as an operation clock of the timepiece LSI 70. In this case, the AC circuit 81 delivers an all-clear (initialize) signal AC to the timepiece 70. Thus, a normal timepiece operation is restored automatically.

According to this wristwatch, the all-clear signal AC delivered to the timepiece 70 as the power supply voltage Vbat is restored disappears after a predetermined number of basic clock signals CLK is counted (for the predetermined time T) after the oscillator 74 starts its oscillation. Thus, the all-clear process for the timepiece LSI 70 is performed securely and the timepiece 70 returns to its normal timepiece operation.

What is claimed is:

1. An electronic device comprising:

a solar cell;

an electric storage means charged by an output from said solar cell;

illumination detecting means for detecting the brightness of the environment of said solar cell based on the output from said solar cell;

displaying means;

illumining means for illumining said displaying means;

attitude detecting means for detecting an attitude of the electronic device;

driving means for driving said illumining means on the basis of the attitude of the electronic device detected by said attitude detecting means and the result of the detection by said illumination detecting means.

2. The electronic device according to claim 1, wherein said attitude detecting means comprises a slant switch means turned on when the electronic device is slanted in a specified direction.

3. The electronic device according to claim 1, wherein said driving means turns on said illumining means only when the output voltage from said solar cell detected by said voltage detecting means is below a predetermined value and the slanting of the electronic device in the specified direction is detected by said attitude detecting means.

4. The electronic device according to claim 1, wherein said illumining means comprises an electroluminescence element.

5. The electronic device according to claim 1, further comprising:

time counting means for counting the present time, and wherein said displaying means displays the present time recorded by said time counting means.

6. The electronic device according to claim 1, further comprising:

time counting means for recording the present time, and wherein said displaying means displays the present time recorded by said time counting means; and said solar cell, illumination detecting means, electric storage means, attitude detecting means, displaying means, illumining means, driving means, and time counting means are enclosed in a wristwatch case wearable on a wrest.

7. The electronic device according to claim 1, wherein said illumination detecting means detects a charged/discharged state of said electric storage means.

8. The electronic device according to claim 1, further comprising:

a first and a second load means driven by an output voltage from said electric storage means;

voltage detecting means for detecting that the output voltage from said electric storage means has dropped to a first and a second voltage;

load drive inhibiting means, responsive to said voltage detecting means detecting that the output voltage from said electric storage means has dropped to the first voltage, for inhibiting the drive of said first load means, and responsive to said voltage detecting means detecting that the output voltage from said electric storage means has dropped to the second voltage, for inhibiting the drive of said first and second load means.

9. The electronic device according to claim 1, comprising:

load means driven by the output voltage from said electric storage means;

voltage detecting means for detecting the output voltage from said electric storage means at predetermined intervals of time;

first reporting means, responsive to said voltage detecting means detecting that the output voltage from said electric storage means has dropped to a predetermined voltage, for reporting this fact;

voltage detection stopping means for stopping the voltage detection by said voltage detecting means a predetermined time after said load means is driven;

accumulating means, responsive to the driving of said load means when the voltage detection by said voltage detection stopping means is at a stop, for accumulating data corresponding to amperage consumed by the driving of said load means; and second reporting means, responsive to said accumulating means having accumulated a present quantity of data, for reporting this fact.

10. The electronic device according to claim 1, further comprising:

oscillator means driven by the output voltage from said electric storage means;

electronic circuit means driven by the output voltage from said electric storage means for performing a predetermined operation on the basis of a signal generated by said oscillator means;

oscillation start detecting means for detecting that said oscillator means which has stopped its oscillation due to a drop in the output voltage from said electric storage means has started its oscillation due to restoration of the output voltage from said electric storage means; and reset signal generating means, responsive to said oscillation start detecting means having detected the start of the oscillation by said oscillator means, for resetting said electronic circuit means to its initial state.

11. The electronic device according to claim 10, wherein said reset signal generating means is responsive to said oscillator start detecting means having detected the start of oscillation by said oscillator means to generate for a predetermined time a reset signal to reset said electronic circuit means to its initial state.

12. The electronic device according to claim 11, wherein:

the oscillation start voltage of said oscillator means is set at a higher voltage than the operating voltage of said electronic circuit means.

13. The electronic device according to claim 1, further comprising:

oscillator means driven by the output voltage from said electric storage means;

electronic circuit means driven by the output voltage from said electric storage means for performing a predetermined operation on the basis of a signal generated by said oscillator means;

voltage drop detecting means for detecting that the output voltage from said electric storage means has dropped to a particular voltage higher than an oscillation stop voltage at which said oscillator means stops its oscillation; and reset signal generating means, responsive to said voltage drop detecting means having detected that the output voltage from said electric storage means has dropped to the particular voltage, for resetting said electronic circuit means to its initial state.

14. The electronic device according to claim 13, wherein the oscillation stop voltage for said oscillation means is lower than the operating voltage of said electronic circuit means, and said specified voltage is higher than the operating voltage of said electronic circuit means.

* * * * *